US011365727B2

(12) United States Patent
Kuroda et al.

(10) Patent No.: US 11,365,727 B2
(45) Date of Patent: Jun. 21, 2022

(54) FAILURE DIAGNOSING DEVICE, PUMP UNIT INCLUDING SAME, AND FAILURE DIAGNOSING METHOD

(71) Applicant: KAWASAKI JUKOGYO KABUSHIKI KAISHA, Kobe (JP)

(72) Inventors: Tadahiko Kuroda, Akashi (JP); Takayuki Masuda, Kobe (JP); Takeshi Matsuura, Nishinomiya (JP); Yuki Kato, Akashi (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 345 days.

(21) Appl. No.: 16/630,913

(22) PCT Filed: Jul. 27, 2018

(86) PCT No.: PCT/JP2018/028345
§ 371 (c)(1),
(2) Date: Jan. 14, 2020

(87) PCT Pub. No.: WO2019/022252
PCT Pub. Date: Jan. 31, 2019

(65) Prior Publication Data

US 2020/0158146 A1 May 21, 2020

(30) Foreign Application Priority Data

Jul. 28, 2017 (JP) ..... JP2017-146993
Jul. 28, 2017 (JP) ..... JP2017-146994

(51) Int. Cl.
*F04B 1/328* (2020.01)
*F04B 43/12* (2006.01)
(Continued)

(52) U.S. Cl.
CPC ..... *F04B 1/328* (2013.01); *F04B 43/1207* (2013.01); *F04B 49/065* (2013.01); *F04B 51/00* (2013.01); *F15B 19/005* (2013.01)

(58) Field of Classification Search
CPC .... F04B 1/328; F04B 43/1207; F04B 49/065; F04B 51/00; F04B 1/22; F04B 49/10;
(Continued)

(56) References Cited

U.S. PATENT DOCUMENTS 4,801,247 A * 1/1989 Hashimoto ..... F04B 49/06 417/213
6,425,450 B1 * 7/2002 Lansberry ..... B62D 55/02 180/9.42
(Continued)

FOREIGN PATENT DOCUMENTS

JP 3014560 B2 2/2000
JP 2016-053308 A 4/2016

OTHER PUBLICATIONS

Grabill, Paul; Vibration_Monitoring_Techniques_Investigated_for_the_Monitoring_of_a_CH-47D_Swashplate_Bearing; May 2003; https://www.researchgate.net/publication/344548280_ (Year: 2003).*
(Continued)

*Primary Examiner* — Francis C Gray
(74) *Attorney, Agent, or Firm* — Oliff PLC

(57) ABSTRACT

A failure diagnosing device configured to diagnose failure of a swash plate pump includes: a history acquiring portion configured to acquire actual history data, the actual history data indicating a time-lapse change of the suction flow rate or suction pressure in a predetermined period of time; and a failure detecting portion configured to detect generation of an abnormality between a piston and a shoe based on the actual history data acquired by the history acquiring portion.

14 Claims, 18 Drawing Sheets

(51) Int. Cl.
*F04B 49/06* (2006.01)
*F04B 51/00* (2006.01)
*F15B 19/00* (2006.01)

(58) Field of Classification Search
CPC .... F04B 1/30; F04B 2205/01; F04B 2205/09; F15B 19/005
See application file for complete search history.

(56) References Cited

U.S. PATENT DOCUMENTS

2012/0291622 A1* 11/2012 Ikeda ..... F04B 49/12 91/1
2017/0284387 A1 10/2017 Tomochika et al.

OTHER PUBLICATIONS

Casoli, Paolo; A_Methodology_Based_on_Cyclostationary_Analysis_for_Fault_Detection_of_Hydraulic_Axial_Piston_Pumps; Jul. 2018; https://www.researchgate.net/publication/326477853_ (Year: 2018).*
The Author(s); A multi-sensor fault detection strategy for axial piston pump using the Walsh transform method; 2018 (Year: 2018).*

* cited by examiner

TIME[s]

FAILURE DIAGNOSING DEVICE, PUMP UNIT INCLUDING SAME, AND FAILURE DIAGNOSING METHOD

TECHNICAL FIELD

The present invention relates to a failure diagnosing device configured to diagnose failure of a swash plate pump and a pump unit including the failure diagnosing device.

BACKGROUND ART

Hydraulic pumps are widely utilized in industrial machines, such as machines for ships and construction machines. A swash plate pump is known as one example of the hydraulic pump. The swash plate pump includes a plurality of pistons. The plurality of pistons are inserted in a cylinder block so as to be able to reciprocate, the cylinder block being configured to rotate about a rotating shaft. Shoes are provided at the respective pistons, and the pistons are arranged on a swash plate through the shoes. The piston and the shoe constitute a spherical joint portion at a portion where the piston and the shoe are coupled to each other. The piston and the shoe are coupled to each other so as to be able to swing relative to each other. In the swash plate pump configured as above, when the rotating shaft is driven to rotate by an engine, a motor, or the like, the shoes and the pistons rotate on the swash plate arranged so as to be inclined relative to the rotating shaft. With this, the pistons retreat and advance relative to the cylinder block, and thereby, the swash plate pump sucks and discharges an operating liquid.

In the swash plate pump, in order to realize the above-described operations, the piston and the shoe can swing relative to each other at the spherical joint portion. Therefore, the piston and the shoe wear away at the spherical joint portion, and this generates an abnormality (i.e., looseness) between the piston and the shoe. The amount of looseness (i.e., a gap between the piston and the shoe) increases in accordance with a use time of the pump. If the amount of looseness increases, the piston falls off from the shoe sooner or later. In this case, the swash plate pump does not function, and all the functions of a hydraulic circuit are lost. The looseness generated between the piston and the shoe often occurs as failure of the swash plate pump. Therefore, it is preferable to detect such failure in advance. For example, a failure diagnosing device of PTL 1 is known as such device configured to detect the failure in advance, and an overhaul timing diagnosing method of PTL 2 is also known.

According to the failure diagnosing device of PTL 1, a pulsation waveform is generated by measuring discharge pressure of a piston pump, and common components of each piston and a specific component of each piston are separated from the pulsation waveform. Further, a feature amount is calculated from the specific component, and failure of the piston pump (i.e., looseness between the piston and the shoe) is detected based on whether or not the feature amount is a threshold or more. According to the overhaul timing diagnosing method of PTL 2, discharge pressure of a piston pump is measured, and a spectrum of a pulsation waveform of the discharge pressure is detected, i.e., a pulsation spectrum is detected. Based on whether or not the waveform is such a waveform that a peculiar peak of the detected pulsation spectrum becomes higher at a high frequency component, the necessity of overhaul is determined, i.e., the failure of the piston pump is detected.

CITATION LIST

Patent Literature

PTL 1: Japanese Laid-Open Patent Application Publication No. 2016-53308

PTL 2: Japanese Patent No. 3014560

SUMMARY OF INVENTION

Technical Problem

According to the failure diagnosing device of PTL 1 and the overhaul timing diagnosing method of PTL 2, the discharge pressure is measured, and the abnormality (i.e., the looseness) between the piston and the shoe is detected based on the pulsation waveform of the measured discharge pressure. However, each of PTLs 1 and 2 just describes a tendency of the pulsation waveform of the discharge pressure which tendency is generated by the failure and does not describe a mechanism of how the failure influences the pulsation waveform of the discharge pressure. Therefore, the degree of detection accuracy secured is unclear. Further, various valves and actuators are connected at a discharge side of the piston pump, and the discharge pressure tends to be influenced by such valves and actuators. Therefore, it is difficult to set a threshold used to determine the presence or absence of the abnormality, and the detection accuracy of the abnormality is uncertain.

An object of the present invention is to provide a failure diagnosing device capable of improving detection accuracy of an abnormality generated between a piston and a shoe, and a pump unit including the failure diagnosing device.

Solution to Problem

A failure diagnosing device of the present invention is a failure diagnosing device for a swash plate pump, the swash plate pump including: a cylinder block configured to rotate about a predetermined axis; a plurality of pistons inserted in the cylinder block so as to be reciprocable; shoes provided at the respective pistons so as to be swingable; and a swash plate on which the shoes slidably rotate, wherein: when the cylinder block rotates, the plurality of pistons reciprocate in the cylinder block, and thereby, the swash plate pump sucks and discharges an operating liquid, the failure diagnosing device including: a history acquiring portion configured to acquire actual history data indicating a time-lapse change of a suction flow rate or suction pressure in a predetermined period of time; and a failure detecting portion configured to detect generation of an abnormality between the piston and the shoe based on the actual history data acquired by the history acquiring portion.

According to the present invention, the abnormality between the piston and the shoe can be detected based on the suction flow rate or suction pressure of the swash plate pump. A change in the suction flow rate or suction pressure of the swash plate pump due to an external factor is smaller than a change in discharge pressure of the swash plate pump due to an external factor, and influence on the suction flow rate or suction pressure of the swash plate pump by the abnormality tends to appear significantly. Therefore, by detecting the abnormality based on the suction flow rate or suction pressure of the swash plate pump, the abnormality can be accurately detected, and the detection accuracy of the abnormality can be improved.

In the above invention, the failure diagnosing device may be configured such that: the actual history data indicates the time-lapse change of the suction flow rate in the predetermined period of time; the failure diagnosing device further includes a storage portion configured to prestore reference history data indicating the time-lapse change of the suction flow rate in the predetermined period of time, the reference history data being used as a determination criterion when detecting the generation of the abnormality; and the failure detecting portion detects the generation of the abnormality by comparing the actual history data with the reference history data.

According to the above configuration, the generation of the abnormality can be detected by comparing the prestored reference history data with the detected actual history data. Therefore, the generation of the abnormality can be detected accurately and easily.

In the above invention, the failure diagnosing device may be configured such that: the failure detecting portion divides each of the actual history data and the reference history data into a predetermined number of sections; and the failure detecting portion calculates a looseness amount based on a difference between the suction flow rate of the actual history data and the suction flow rate of the reference history data regarding each of the corresponding sections, the looseness amount indicating an amount of the abnormality.

According to the above configuration, since the looseness amount can be detected, the failure of the swash plate pump can be determined quantitatively, not qualitatively. To be specific, determinations regarding a replacement timing of the piston, the degree of the failure of the swash plate pump, and the like can be flexibly performed in accordance with the looseness amount.

In the above invention, the failure diagnosing device may be configured such that: the actual history data indicates the time-lapse change of the suction flow rate in the predetermined period of time; the history acquiring portion acquires the actual history data of the suction flow rate of the operating liquid sucked in a period in which the cylinder block rotates once; and the failure detecting portion divides the actual history data into a predetermined number of sections and detects the generation of the abnormality by comparing the suction flow rates in the respective sections with one another.

According to the above configuration, the generation of the abnormality can be accurately detected without a history as a comparison target, and therefore, the failure diagnosing device can be easily configured.

In the above invention, the failure diagnosing device may be configured such that the failure detecting portion calculates a looseness amount based on a difference between the suction flow rates in predetermined two of the sections, the looseness amount indicating an amount of the abnormality.

According to the above configuration, since the looseness amount can be detected, the failure of the swash plate pump can be determined quantitatively, not qualitatively. Therefore, determinations regarding the replacement timing of the piston, the degree of the failure of the swash plate pump, and the like can be flexibly determined in accordance with the looseness amount.

In the above invention, the failure diagnosing device may be configured such that: the actual history data indicates the time-lapse change of the suction flow rate in the predetermined period of time; the history acquiring portion acquires the actual history data containing actual waveform data indicating the time-lapse change of the suction flow rate in the predetermined period of time; and the failure detecting portion detects the generation of the abnormality based on the waveform data.

According to the above configuration, the generation of the abnormality can be detected based on the waveform data.

In the above invention, the failure diagnosing device may be configured such that: the history acquiring portion acquires the actual history data containing actual waveform data indicating the time-lapse change of the suction flow rate in the predetermined period of time; the storage portion stores the reference history data containing reference waveform data indicating the time-lapse change of the suction flow rate in the predetermined period of time; and the failure detecting portion detects the generation of the abnormality by comparing the actual waveform data with the reference waveform data.

According to the above configuration, the generation of the looseness can be detected by comparing the actual waveform data with the reference waveform data.

In the above invention, the failure diagnosing device may be configured such that: the actual history data indicates the time-lapse change of the suction pressure in the predetermined period of time; the failure diagnosing device further includes a storage portion configured to prestore reference history data indicating the time-lapse change of the suction pressure in the predetermined period of time, the reference history data being used as a determination criterion when detecting the generation of the abnormality; and the failure detecting portion detects the generation of the abnormality by comparing the actual history data with the reference history data.

According to the above configuration, the generation of the abnormality can be detected by comparing the prestored reference history data with the detected actual history data. Therefore, the generation of the abnormality can be detected accurately and easily.

In the above invention, the failure diagnosing device may be configured such that: the failure detecting portion divides each of the actual history data and the reference history data into a predetermined number of sections; and the failure detecting portion detects the generation of the abnormality based on a difference between the actual history data and the reference history data regarding each of the corresponding sections.

According to the above configuration, since each of the actual history data and the reference history data is divided into a predetermined number of sections, and the actual history data and the reference history data are compared with each other, such comparison is easy. Therefore, the generation of the abnormality can be easily detected.

In the above invention, the failure diagnosing device may be configured such that: the actual history data indicates the time-lapse change of the suction pressure in the predetermined period of time; the history acquiring portion acquires the actual history data containing waveform data indicating the time-lapse change of the suction pressure in the predetermined period of time; and the failure detecting portion detects the generation of the abnormality based on the waveform data.

According to the above configuration, the generation of the abnormality can be detected based on the waveform data.

In the above invention, the failure diagnosing device may be configured such that: the history acquiring portion acquires the actual history data containing actual waveform data indicating the time-lapse change of the suction pressure in the predetermined period of time; the storage portion stores the reference history data containing reference waveform data indicating the time-lapse change of the suction pressure in the predetermined period of time; and the failure detecting portion detects the generation of the abnormality by comparing the actual waveform data with the reference waveform data.

According to the above configuration, the generation of the abnormality can be detected by comparing the actual waveform data with the reference waveform data.

In the above invention, the failure diagnosing device may be configured such that: the failure detecting portion performs frequency analysis of the actual history data; and the failure detecting portion detects the generation of the abnormality based on a result of the frequency analysis.

According to the above configuration, the generation of the abnormality can be accurately detected without a history as a comparison target, and therefore, the failure diagnosing device can be easily configured.

A pump unit of the present invention includes: any one of the above failure diagnosing devices; the swash plate pump; and a sensor device configured to output a signal corresponding to the suction flow rate or suction pressure of the operating liquid sucked by the swash plate pump. The failure diagnosing device includes a flow rate calculating portion configured to calculate the suction flow rate in accordance with the signal from the sensor device or a pressure calculating portion configured to calculate the suction pressure in accordance with the signal from the sensor device.

The present invention can provide the pump unit having the above-described functions.

A failure diagnosing method of the present invention is a failure diagnosing method for a swash plate pump, the swash plate pump including: a cylinder block configured to rotate about a predetermined axis; a plurality of pistons inserted in the cylinder block so as to be reciprocable; shoes provided at the respective pistons so as to be swingable; and a swash plate on which the shoes slidably rotate, wherein: when the cylinder block rotates, the plurality of pistons reciprocate in the cylinder block, and thereby, the swash plate pump sucks and discharges an operating liquid, the failure diagnosing method including: a detecting step of detecting a suction flow rate or suction pressure of the operating liquid sucked by the swash plate pump; a history acquiring step of acquiring actual history data based on the suction flow rate or suction pressure detected in the detecting step, the actual history data indicating a time-lapse change of the suction flow rate or suction pressure in a predetermined period of time; and a failure detecting step of detecting generation of an abnormality between the piston and the shoe based on the actual history data acquired in the history acquiring step.

According to the present invention, the abnormality between the piston and the shoe can be detected based on the suction flow rate or suction pressure of the swash plate pump. A change in the suction flow rate or suction pressure of the swash plate pump due to an external factor is smaller than a change in discharge pressure of the swash plate pump due to an external factor, and influence on the suction flow rate or suction pressure of the swash plate pump by the abnormality tends to appear significantly. Therefore, by detecting the abnormality based on the suction flow rate or suction pressure of the swash plate pump, the abnormality can be accurately detected, and the detection accuracy of the abnormality can be improved.

Advantageous Effects of Invention

According to the present invention, the detection accuracy of the abnormality generated between the piston and the shoe can be improved.

BRIEF DESCRIPTION OF DRAWINGS

FIG. 2A shows a piston and a shoe which have no abnormality. FIG. 2B shows the piston and the shoe which have the abnormality.

FIG. 5A shows the piston and the shoe which have no abnormality. FIG. 5B shows the piston and the shoe which have the abnormality.

FIG. 6A shows the piston and the shoe which have no abnormality. FIG. 6B shows the piston and the shoe which have the abnormality.

FIG. 7A shows the piston and the shoe which have no abnormality. FIG. 7B shows the piston and the shoe which have the abnormality.

FIG. 8A shows the piston and the shoe which have no abnormality. FIG. 8B shows the piston and the shoe which have the abnormality.

Regarding the swash plate pump in which the abnormality is generated at one piston.

Regarding the swash plate pump in which the abnormalities are generated at a plurality of pistons.

FIG. 14A shows a graph in which there is no abnormality. FIG. 14B shows a graph in which there is the abnormality.

FIG. 17A shows a graph in which there is the abnormality. FIG. 17B shows a graph in which there is no abnormality.

FIG. 18A shows a graph in which there is no abnormality. FIG. 18B shows a graph in which there is the abnormality.

DESCRIPTION OF EMBODIMENTS

Hereinafter, pump units 1 and 1A to 1D according to Embodiments 1 to 5 of the present invention will be described with reference to the drawings. Directions mentioned in the following description are used for convenience sake, and directions and the like of components of the present invention are not limited. Further, each of the pump units 1 and 1A to 1D described below is just one embodiment of the present invention. Therefore, the present invention is not limited to the embodiment, and additions, deletions, and modifications may be made within the scope of the present invention.

Embodiment 1

Pump Unit

Figure 1:
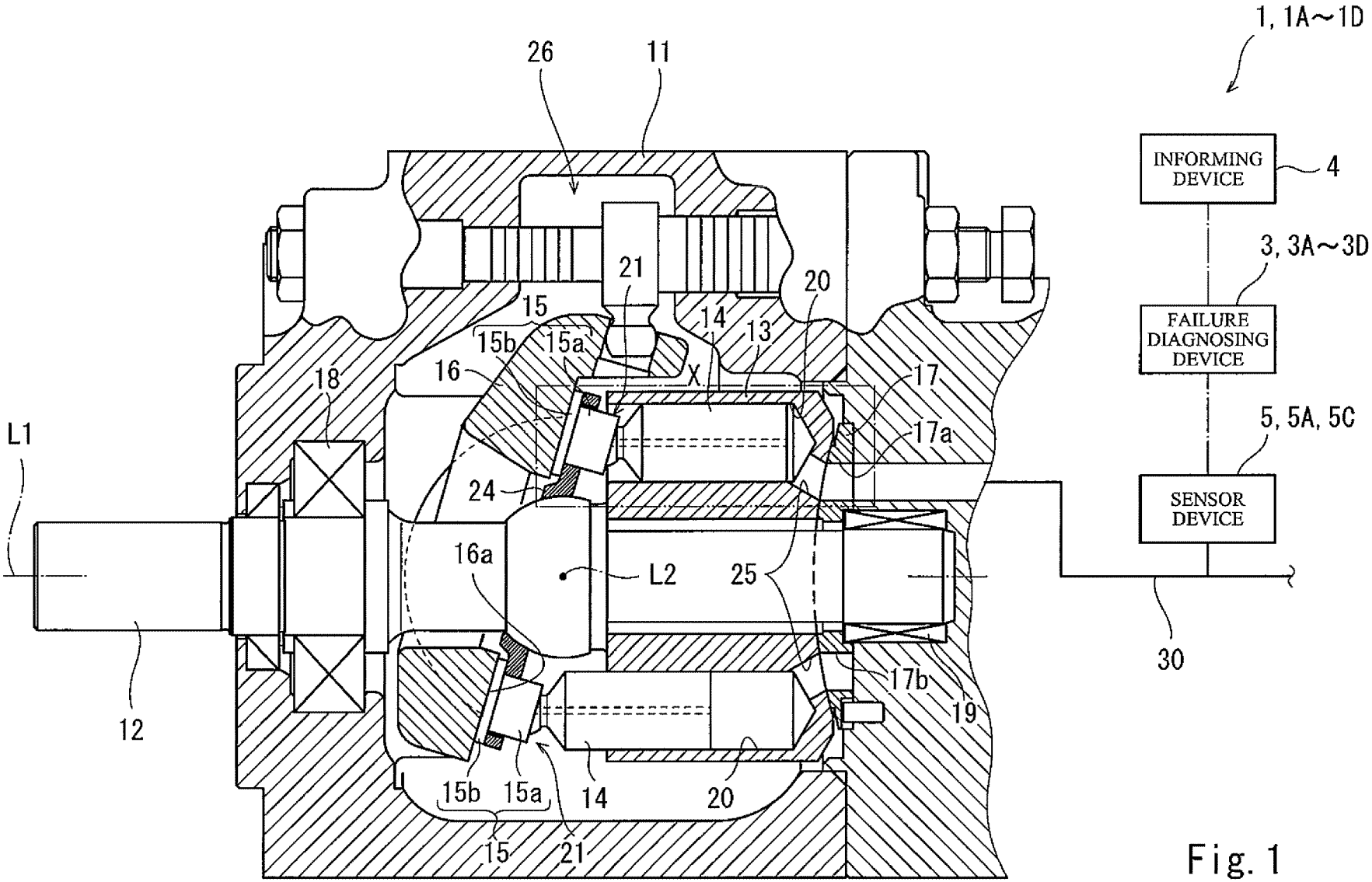
FIG. 1 is a sectional view showing a pump unit according to an embodiment of the present invention.

The pump unit 1 shown in FIG. 1 is used in industrial machines, such as machines for ships and construction machine. The pump unit 1 supplies an operating liquid to a hydraulic device, such as a hydraulic cylinder or a hydraulic motor, to drive the hydraulic device. More specifically, the pump unit 1 includes a swash plate pump 2. The swash plate pump 2 sucks the low-pressure operating liquid from a tank or the like, pressurizes the operating liquid, and discharges the high-pressure operating liquid. The discharged operating liquid is supplied to the hydraulic device through, for example, a pipe, and the hydraulic device is driven by the supplied operating liquid. The pump unit 1 having such function further includes a failure diagnosing device 3 and an informing device 4. The pump unit 1 can diagnose the presence or absence of failure of the swash plate pump 2 by the failure diagnosing device 3. More specifically, the pump unit 1 can detect the generation of an abnormality (i.e., looseness) between a below-described piston 14 and a below-described shoe 15. The failure diagnosing device 3 outputs a diagnosis result to the informing device 4, and the informing device 4 informs of information based on the diagnosis result. The informing device 4 is a display device (such as a monitor), a warning device, and a sound output device and can inform visually and audibly. First, the following will describe the swash plate pump 2 that is a diagnosis target in the pump unit 1 configured as above.

Swash Plate Pump

The swash plate pump 2 is, for example, a variable displacement swash plate pump. A discharge flow rate (i.e., a suction flow rate) of the swash plate pump 2 can be changed by changing a tilting angle of a swash plate 16 described below in detail. More specifically, the swash plate pump 2 includes a casing 11, a rotating shaft 12, a cylinder block 13, a plurality of pistons 14, a plurality of shoes 15, the swash plate 16, and a valve plate 17. The casing 11 is configured to accommodate the rotating shaft 12, the cylinder block 13, the plurality of pistons 14, the plurality of shoes 15, the swash plate 16, and the valve plate 17. One of end portions of the rotating shaft 12 projects from the casing 11 and is coupled to a prime mover, such as an engine or a motor. Bearings 18 and 19 are provided at a portion, close to the one end portion, of the rotating shaft 12 and the other end portion of the rotating shaft 12, respectively. The rotating shaft 12 is supported by the casing 11 through the bearings 18 and 19 so as to be rotatable. Further, the cylinder block 13 is inserted through a portion of the rotating shaft 12, the portion being located between the bearings 18 and 19 and close to the other end portion.

The cylinder block 13 is formed in a substantially cylindrical shape. The cylinder block 13 is coaxially coupled (for example, splined) to the rotating shaft 12 so as not to be rotatable relative to the rotating shaft 12. Therefore, the cylinder block 13 rotates about an axis L1 integrally with the rotating shaft 12. The cylinder block 13 includes a plurality of cylinder chambers (in the present embodiment, nine cylinder chambers) 20. Each of the cylinder chambers 20 is a hole that is open at one end side of the cylinder block 13 and extends in parallel with the axis L1. The plurality of cylinder chambers 20 are arranged at regular intervals in a circumferential direction about the axis L. The pistons 14 are inserted into the respective cylinder chambers 20 through the openings.

Each of the pistons 14 is a so-called male piston and includes a piston main body 14*a* and a convex spherical portion 14*b*. The piston main body 14*a* is formed in a substantially columnar shape and inserted into the cylinder chamber 20. One axial end side of the piston main body 14*a* projects from the cylinder chamber 20 with the piston main body 14*a* inserted in the cylinder chamber 20. The convex spherical portion 14*b* is integrally formed at one axial end portion of the piston main body 14*a*. The shoe 15 is attached to the convex spherical portion 14*b*.

The shoe 15 includes an accommodating portion 15*a* and a base body portion 15*b*. The accommodating portion 15*a* is formed in a substantially cylindrical shape, and an accommodating space 15*c* (see FIG. 2A) in the accommodating portion 15*a* is formed in a partially spherical shape. More specifically, the accommodating space 15*c* is formed so as to correspond to the shape of the convex spherical portion 14*b*. The convex spherical portion 14*b* can be accommodated in the accommodating space 15*c*. In a state where the accommodating space 15*c* accommodates the convex spherical portion 14*b*, an opening end portion 15*d* of the accommodating portion 15*a* is subjected to caulking. With this, the convex spherical portion 14*b* is fitted in the accommodating portion 15*a* so as to be swingable, and the piston 14 and the shoe 15 are coupled to each other so as to be swingable. The convex spherical portion 14*b* and the accommodating portion 15*a* constitute a spherical joint portion 21. The base body portion 15*b* is formed integrally with an end surface of the accommodating portion 15*a* of the shoe 15, the end surface being located opposite to the opening end portion 15*d*. The base body portion 15*b* is formed in a substantially circular plate shape and is larger in diameter than the accommodating portion 15*a*. The accommodating portion 15*a* is integrally formed on one of thickness-direction surfaces of the base body portion 15*b*. The other thickness-direction surface of the base body portion 15*b* is formed to be flat. The base body portion 15*b* is pressed against the swash plate 16 such that the other thickness-direction surface thereof contacts the swash plate 16.

The swash plate 16 is a plate having a substantially annular shape. The rotating shaft 12 is inserted into an inner hole of the swash plate 16. The swash plate 16 is arranged in the casing 11 so as to be inclined relative to the rotating shaft 12. One of thickness-direction surfaces of the swash plate 16 arranged as above is formed to be flat and forms a supporting surface 16*a*. The supporting surface 16*a* faces one of end surfaces of the cylinder block 13 in an inclined state. The base body portions 15*b* of the plurality of shoes 15 are arranged on the supporting surface 16*a* at intervals in the circumferential direction. The plurality of shoes 15 arranged as above are pressed against the supporting surface 16*a* by a retainer plate 24. The shoes 15 slidably rotate on the supporting surface 16*a* about the axis L while being pressed by the retainer plate 24. To be specific, the plurality of shoes 15 are arranged on the inclined supporting surface 16*a* and rotate about the axis L1 on the supporting surface 16*a*. Therefore, when the shoes 15 rotate on the supporting surface 16*a*, the shoes 15 approach and separate from the cylinder block 13. On this account, when the cylinder block 13 rotates, and this rotates the pistons 14 about the axis L1, the pistons 14 are made to reciprocate in the cylinder chambers 20 by the shoes 15. Further, the cylinder block 13 includes a plurality of cylinder ports 25 through which the operating liquid is sucked and discharged.

The plurality of cylinder ports 25 are formed at the other end side of the cylinder block 13. The cylinder ports 25 are formed so as to correspond to the cylinder chambers 20 one to one. The plurality of cylinder ports 25 include respective openings at the other end of the cylinder block 13, and the openings are arranged at intervals in the circumferential direction about the axis L1. The valve plate 17 is provided at the other end of the cylinder block 13. The valve plate 17 is formed in a substantially circular plate shape. The rotating shaft 12 is inserted through a center of the valve plate 17 so as to be rotatable relative to the valve plate 17. The valve plate 17 is fixed to the casing 11 with one of thickness-direction surfaces thereof contacting the other end of the cylinder block 13. The valve plate 17 arranged as above includes an inlet port 17*a* and an outlet port 17*b*. Each of the inlet port 17*a* and the outlet port 17*b* is a hole that penetrates the valve plate 17 in a thickness direction and extends in the circumferential direction. The inlet port 17*a* and the outlet port 17*b* are arranged so as to be spaced apart from each other in the circumferential direction. The inlet port 17*a* and the outlet port 17*b* are arranged so as to correspond to the plurality of cylinder ports 25. More specifically, four or five cylinder ports 25 are connected to each of the ports 17*a* and 17*b* at all times. When the cylinder block 13 rotates, the port to which each cylinder port 25 is connected is switched between the ports 17*a* and 17*b*. It should be noted that for convenience of explanation, FIG. 1 shows that the cylinder port 25 of the cylinder chamber 20 at a bottom dead center and the cylinder port 25 of the cylinder chamber 20 at a top dead center are coupled to the ports 17*a* and 17*b*, respectively. Actually, the cylinder ports 25 are blocked in the vicinity of the bottom dead center (a position at a lower side in FIG. 1) and also in the vicinity of the top dead center (a position at an upper side in FIG. 1).

Figure 3:
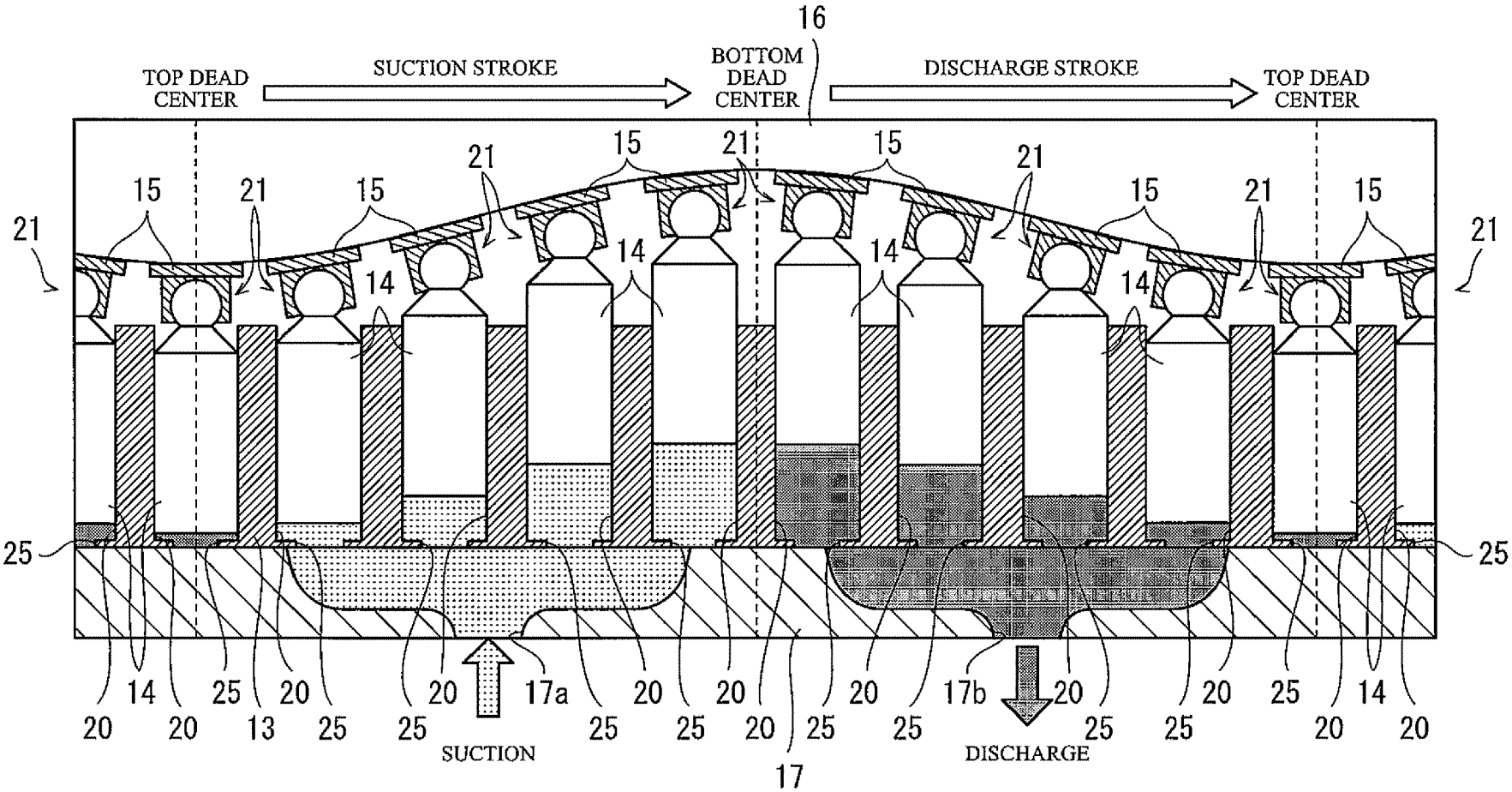
FIG. 3 is a development view showing movement of the piston that rotates on a swash plate in the swash plate pump of FIG. 1.

In the swash plate pump 2 configured as above, the rotating shaft 12 is driven to rotate by the prime mover. When the rotating shaft 12 rotates, the plurality of pistons 14 reciprocate in the cylinder chambers 20 as shown in FIG. 3. With this, the operating liquid is sucked from, for example, a tank through the inlet port 17*a* to the cylinder chambers 20 (suction stroke), and the operating liquid sucked in the cylinder chambers 20 is discharged through the outlet port 17*b* (discharge stroke). The flow rate of the operating liquid discharged from the port 17*b* is determined in accordance with the tilting angle of the swash plate 16. The swash plate pump 2 includes a servo mechanism 26, and the tilting angle of the swash plate 16 can be changed by the servo mechanism 26. To be specific, the servo mechanism 26 is configured to be able to tilt the swash plate 16 around an axis L2. A stroke amount of the piston 14 changes by the tilting of the swash plate 16. With this, the amount of operating liquid discharged through the outlet port 17*b* (i.e., a pump capacity) is changed.

Figure 2A:
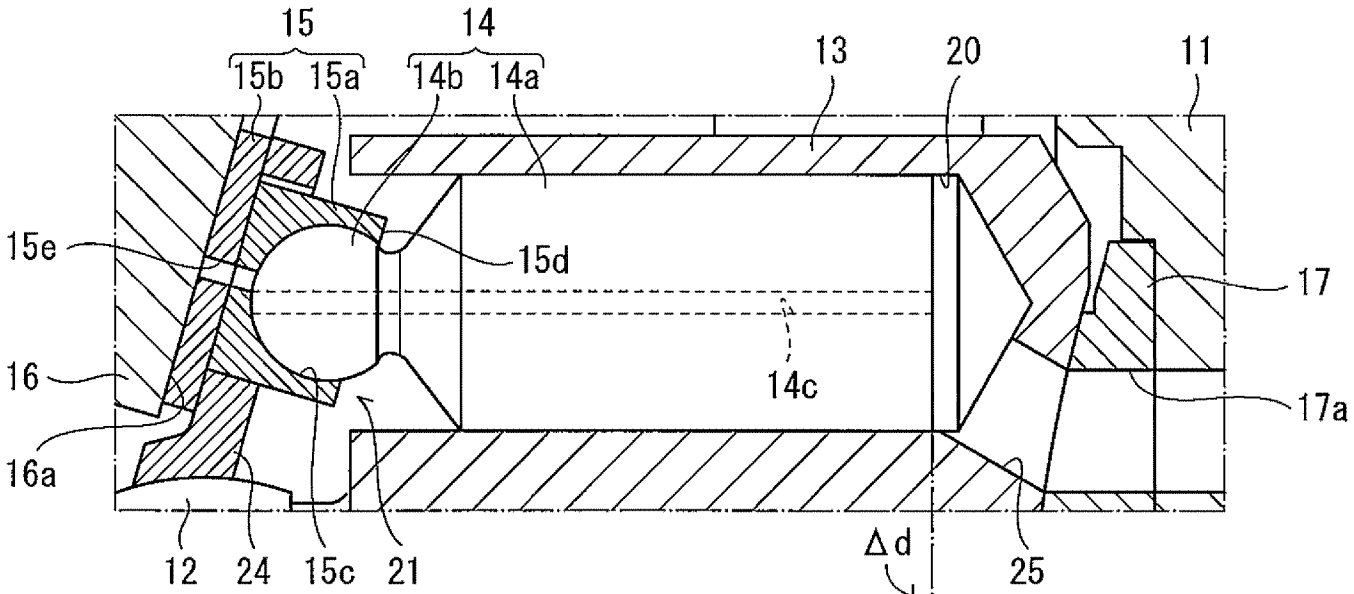
FIGS. 2A and 2B are enlarged sectional views each showing a region X of a swash plate pump included in the pump unit of FIG. 1.

As shown in FIG. 2A, a communication passage 14*c* is formed in the piston 14 of the swash plate pump 2 so as to penetrate the piston 14 along an axis of the piston 14. The communication passage 14*c* introduces the operating liquid of the cylinder chamber 20 to the accommodating space 15*c* of the shoe 15. More specifically, the communication passage 14*c* introduces the operating liquid of the cylinder chamber 20 to between an outer surface of the convex spherical portion 14*b* and an inner surface of the accommodating portion 15*a*. A communication passage 15*e* is formed in the shoe 15 along an axis of the shoe 15 (i.e., an axis of the accommodating portion 15*a* and the base body portion 15*b*), and the above-described operating liquid can be introduced through the communication passage 15*e* to the supporting surface 16*a*. As above, in the swash plate pump 2, the operating liquid is introduced to the accommodating space 15*c* and the supporting surface 16*a* through the two communication passages 14*c* and 15*e*, and the introduced operating liquid is used as a lubricating liquid. With this, wear between the convex spherical portion 14*b* and the accommodating portion 15*a* at the spherical joint portion 21 is suppressed. However, the wear between the piston 14 and the shoe 15 cannot be completely prevented only by the introduced lubricating liquid. Sooner or later, the abnormality (i.e., the looseness) is generated between the convex spherical portion 14*b* and the accommodating portion 15*a* by the wear. In order to detect such abnormality, the pump unit 1 includes the failure diagnosing device 3.

Failure Diagnosing Device

The failure diagnosing device 3 detects the generation of the failure of the swash plate pump 2, i.e., the generation of the abnormality based on a history of the suction flow rate, i.e., a history of the flow rate of the operating liquid sucked by the swash plate pump 2 in a predetermined period of time, such as in a period in which the cylinder block 13 rotates once. It should be noted that the history contains a time history and a time history waveform. The time history of the suction flow rate is history information indicating a time-lapse change of the suction flow rate, and the time history waveform is a waveform indicating the time-lapse change of the suction flow rate. The failure diagnosing device 3 cooperates with a sensor device 5 to detect the suction flow rate in order to detect the generation of the abnormality. The following methods are used for detecting the suction flow rate. To be specific, as the method of detecting the suction flow rate, there are various methods, such as a differential pressure method, an ultrasound method, an electromagnetic method, a Coriolis method, and a volume method. In the present embodiment, the differential pressure method is adopted as the method of detecting the suction flow rate. The failure diagnosing device 3 is connected to the sensor device 5 in order to detect the suction flow rate.

The sensor device 5 is provided on a pipe 30 connecting the inlet port 17*a* and the tank or the like. The sensor device 5 includes two pressure sensors. The two pressure sensors are arranged on the pipe 30 so as to be separated from each other by a predetermined distance. The two pressure sensors detect pressure p1 and pressure p2 (i.e., upstream pressure p1 and downstream pressure p2) at two positions of the pipe 30. The two pressure sensors respectively output a signal corresponding to the upstream pressure p1 and a signal corresponding to the downstream pressure p2, and the two output signals are input to the failure diagnosing device 3. For example, the failure diagnosing device 3 includes a CPU (Central Processing Unit), a ROM (Read Only Memory), a RAM (Random Access Memory), and the like (which are not shown). The ROM stores a program executed by the CPU, various fixed data, and the like. The program executed by the CPU is stored in a storage medium, such as a flexible disk, a CD-ROM, or a memory card, and is installed to the ROM from the storage medium. The RAM temporarily stores data necessary when executing the program.

Figure 4:
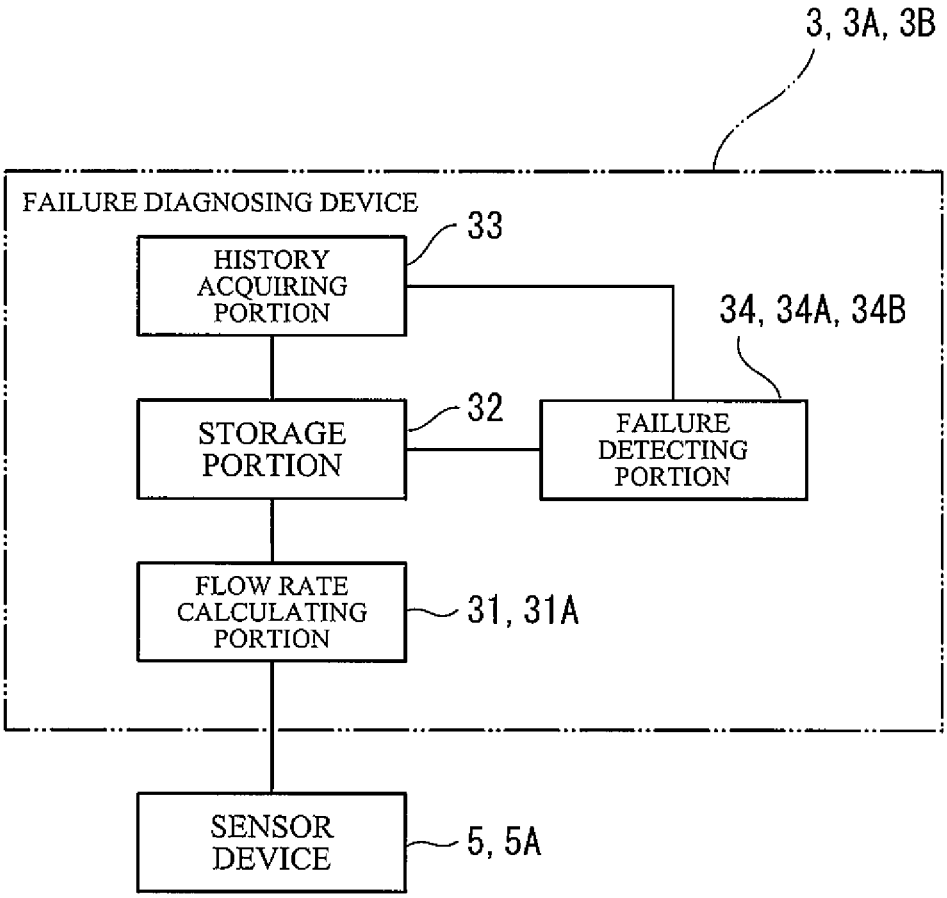
FIG. 4 is a block diagram showing a failure diagnosing device included in the pump unit according to Embodiments 1 to 3.

The failure diagnosing device 3 configured as above calculates the suction flow rate based on the two signals input from the sensor device 5 and detects the generation of the abnormality based on the detected suction flow rate. More specifically, as shown in FIG. 4, the failure diagnosing device 3 includes a flow rate calculating portion 31, a storage portion 32, a history acquiring portion 33, and a failure detecting portion 34. The flow rate calculating portion 31 is connected to the sensor device 5. The two signals from the sensor device 5, i.e., the signals output from the two pressure sensors are input to the flow rate calculating portion 31. The flow rate calculating portion 31 calculates the suction flow rate based on the two input signals. To be specific, first, the flow rate calculating portion 31 calculates the upstream pressure p1, the downstream pressure p2, and a differential pressure Δp between the upstream pressure p1 and the downstream pressure p2 based on the two signals. Then, based on the obtained differential pressure Δp, the flow rate calculating portion 31 calculates the flow rate of the operating liquid flowing through the pipe 30 (by using, for example, Euler's equation of motion). The flow rate of the operating liquid flowing through the pipe 30 corresponds to the suction flow rate, and the flow rate calculated as above is detected as the suction flow rate. The flow rate calculating portion 31 having such function acquires the two signals from the sensor device 5 at predetermined time intervals, detects the suction flow rates at the same time intervals, and stores the suction flow rates in the storage portion 32.

The storage portion 32 can store a plurality of suction flow rates. The storage portion 32 stores the suction flow rate (i.e., an actual suction flow rate), detected by the flow rate calculating portion 31, in association with a time when the suction flow rate is detected. The history acquiring portion 33 acquires actual history data based on the plurality of actual suction flow rates stored as above. The actual history data indicates a history in a predetermined diagnosis period. In the present embodiment, the diagnosis period is set to a cycle T[s] of the rotating shaft 12. The cycle T can be acquired by calculation based on a target rotational frequency of the rotating shaft 12 that rotates at a fixed rotational frequency or can be detected based on a signal from a rotation angle sensor (not shown), a rotation detector, or the like provided at the rotating shaft 12. More specifically, first, the history acquiring portion 33 acquires an actual time history based on the plurality of actual suction flow rates stored in the storage portion 32. The actual time history is a time history in a predetermined diagnosis period. Then, based on the acquired actual history data, the history acquiring portion 33 creates time history waveform data (i.e., actual waveform data; see FIGS. 12A and 13A described below). Further, the storage portion 32 stores the following information in association with the actual history data and the actual waveform data.

To be specific, the storage portion 32 stores reference history data. The reference history data contains a reference time history and its time history waveform data (reference waveform data). The reference time history corresponds to the actual time history and indicates a time-lapse change of a reference suction flow rate in a period that is substantially the same as the diagnosis period. The reference suction flow rate is a suction flow rate detected at an early stage in the swash plate pump 2, a suction flow rate detected in a master swash plate pump that is the same in type as the swash plate pump 2, or a suction flow rate detected and calculated in a swash plate pump modeled in simulation. The reference suction flow rate is a suction flow rate used as a determination criterion. The reference history data is created by detecting the reference suction flow rate in the diagnosis period in advance. As with the actual waveform data, the reference waveform data is created by plotting the reference time history at respective times. The reference history data containing the reference time history and the reference waveform data is used by the failure detecting portion 34 together with the actual history data in order to detect the generation of the abnormality.

The failure detecting portion 34 detects the generation of the abnormality based on the actual history data acquired by the history acquiring portion 33 and the reference history data stored in the storage portion 32. Specifically, the failure detecting portion 34 determines the presence or absence of the abnormality and calculates a looseness amount that is the amount of abnormality generated between the piston 14 and the shoe 15. When determining the presence or absence of the abnormality, the failure detecting portion 34 compares the actual waveform data contained in the actual history data with the reference waveform data contained in the reference history data. When there is a point of difference between the actual waveform data and the reference waveform data, the failure detecting portion 34 determines that there is the abnormality. Although details will be described later, the failure detecting portion 34 determines the presence or absence of the abnormality by the following method. To be specific, first, the failure detecting portion 34 integrates a difference between the suction flow rates at the point of difference to calculate an integrated value. Then, when the integrated value is larger than a predetermined threshold, the failure detecting portion 34 determines that there is the abnormality. Further, the failure detecting portion 34 calculates the looseness amount by the following method. For example, the failure detecting portion 34 integrates the difference between the suction flow rates at the above-described point of difference and calculates the looseness amount based on the integrated value.

The failure diagnosing device 3 configured as above detects the generation of the abnormality based on the suction flow rate. Hereinafter, in order to clarify the reason why the abnormality can be detected based on the suction flow rate, one example of a mechanism in which the suction flow rate changes by the generation of the abnormality in the swash plate pump 2 will be described with reference to FIGS. 2A to 3 and 5A to 8B.

Relation Between Abnormality and Suction Flow Rate

In the swash plate pump 2, as described above, when the rotating shaft 12 is driven by a driving source, the piston 14 reciprocates in the cylinder chamber 20 (see FIG. 3). To be specific, the piston 14 rotates from the top dead center to the bottom dead center to retreat in the cylinder chamber 20 and sucks the operating liquid into the cylinder chamber 20 through the inlet port 17*a* (suction stroke in FIG. 3). After the piston 14 reaches the bottom dead center, the piston 14 then rotates toward the top dead center. With this, the piston 14 switches its operation from a retreating operation to an advancing operation. The operating liquid in the cylinder chamber 20 is discharged through the outlet port 17*b* by the advancing piston 14 (discharge stroke in FIG. 3). Further, the piston 14 rotates about the axis L1 on the swash plate 16 through the shoe 15 while reciprocating in the cylinder chamber 20. Therefore, as shown in FIG. 3, the piston 14 and the shoe 15 slide on each other, and a spherical head top portion (outer surface) of the convex spherical portion 14*b* and an inner surface of the accommodating portion 15*a* wear away. Thus, the abnormality (i.e., the looseness) is generated between the piston 14 and the shoe 15 at the spherical joint portion 21.

The abnormality between the piston 14 and the shoe 15 is generated due to the following cause other than the above-described cause. To be specific, the abnormality between the piston 14 and the shoe 15 is generated also when the opening end portion 15*d* (so-called caulking portion) of the accommodating portion 15*a* wears away by the convex spherical portion 14*b*. Regardless of the cause of the abnormality, the mechanism in which the suction flow rate changes by the abnormality is the same (i.e., as described below, the suction flow rate changes since the piston 14 does not move relative to the shoe 15 immediately after the start of the suction stroke). The following will describe a case where the abnormality is generated between the piston 14 and the shoe 15 since the spherical head top portion of the convex spherical portion 14*b* wears away as described above.

Figure 2B:
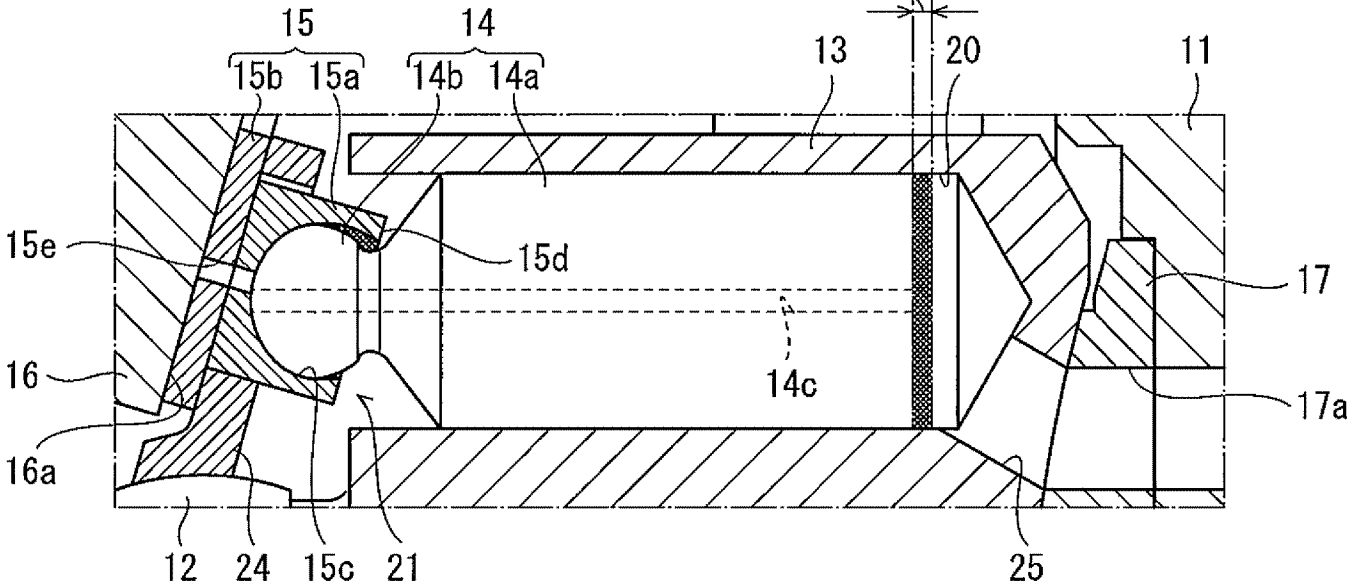

When the abnormality is generated, the movement of the piston 14 in the cylinder chamber 20 changes as below as compared to when the abnormality is not generated. To be specific, the piston 14 performs the advancing operation to the top dead center so as to be pushed toward the swash plate 16 by the operating liquid in the cylinder chamber 20, and as shown in FIGS. 2A and 2B, a tip end-side portion of the convex spherical portion 14*b* of the piston 14 is pressed against a bottom surface of the accommodating portion 15*a* of the shoe 15. On the other hand, when the abnormality is generated, a base end-side portion of the convex spherical portion 14*b* is separated from the opening end portion 15*d* of the accommodating portion 15*a* as shown in FIG. 2B (see a mesh pattern in the shoe 15 in FIG. 2B). Therefore, at the top dead center, when there is the abnormality, the piston 14 is located closer to the swash plate 16 by Δd than when there is no abnormality.

Figure 5A:
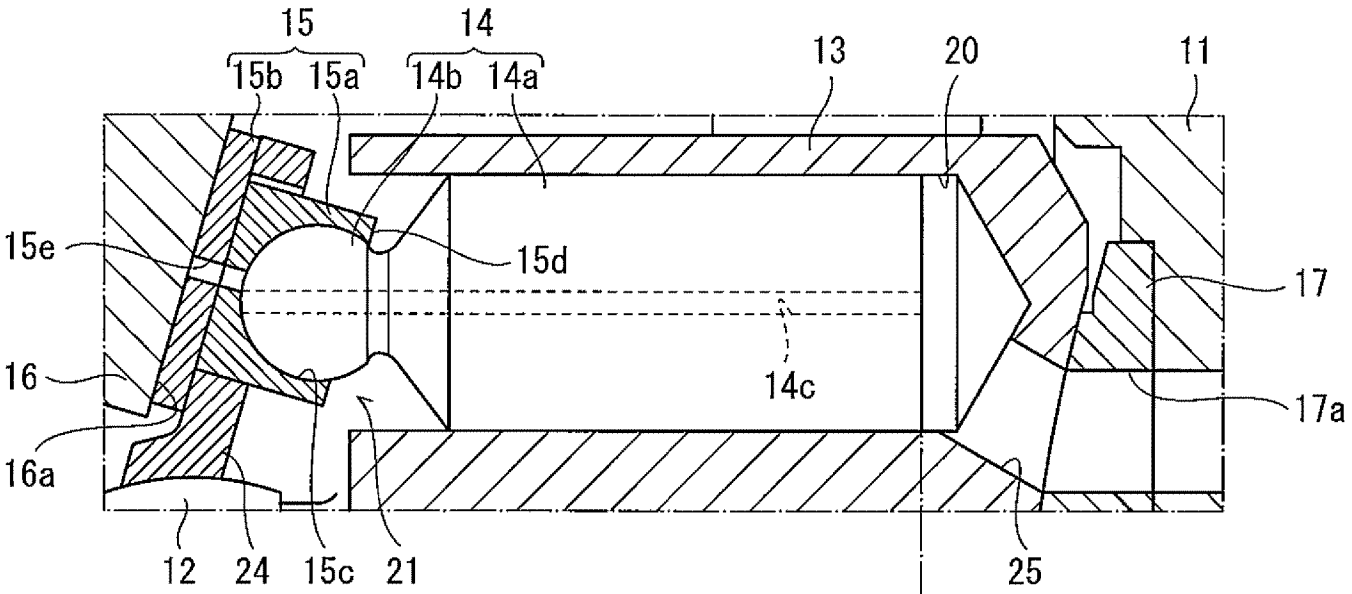
FIGS. 5A and 5B are sectional views showing the piston that is viewed from a lateral side and has slightly moved from a top dead center shown in FIG. 2 toward a bottom dead center in the swash plate pump of FIG. 1.

After that, when the piston 14 starts rotating from the top dead center to the bottom dead center, the shoe 15 rotates together with the piston 14. Since the shoe 15 is pressed against the supporting surface 16*a* of the swash plate 16 by the retainer plate 24, the shoe 15 rotates on the tilted supporting surface 16*a* and retreats along the supporting surface 16*a*. When there is no abnormality, as shown in FIG. 5A, the base end-side portion of the convex spherical portion 14*b* of the piston 14 is pulled by the opening end portion 15*d* of the retreating shoe 15. Thus, the piston 14 passes through the top dead center, and at the same time, starts retreating in the cylinder chamber 20.

Figure 5B:
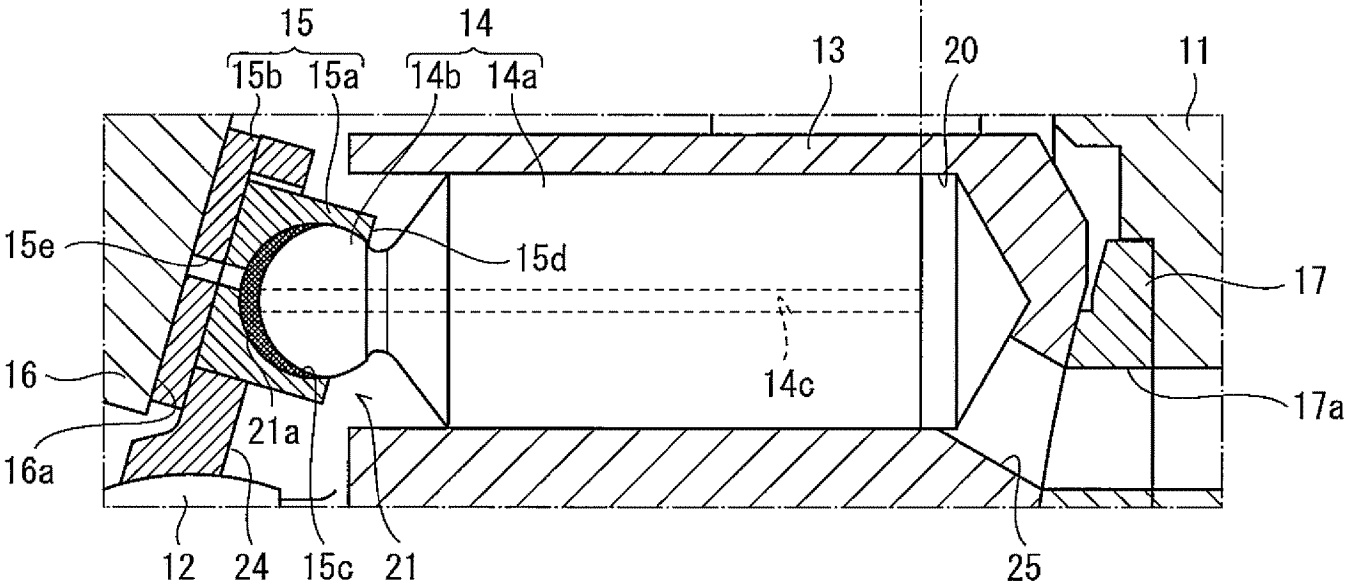

On the other hand, when there is the abnormality, a gap is formed between the base end-side portion of the convex spherical portion 14*b* of the piston 14 and the opening end portion 15*d* in the vicinity of the top dead center (see FIG. 2B). Therefore, the base end-side portion of the convex spherical portion 14*b* cannot be pulled by the opening end portion 15*d*. After the piston 14 passes through the top dead center, the piston 14 does not move in the cylinder chamber 20 and remains stationary. Until the shoe 15 retreats along the swash plate 16 in accordance with the rotation of the cylinder block 13, and the opening end portion 15*d* engages with the base end-side portion of the convex spherical portion 14*b*, the piston 14 remains stationary. Then, as shown in FIG. 5B, when the opening end portion 15*d* engages with the base end-side portion of the convex spherical portion 14*b*, the base end-side portion of the convex spherical portion 14*b* starts being pulled by the opening end portion 15*d* of the shoe 15, and then, the piston 14 starts retreating in the cylinder chamber 20.

As above, when there is the abnormality, a time lag is generated between a timing at which the cylinder block 13 starts moving from the top dead center to the bottom dead center and a timing at which the piston 14 starts retreating in the cylinder chamber 20. During this time lag, the shoe 15 retreats along the swash plate 16 relative to the piston 14 that remains stationary. As a result, the piston 14 and the shoe 15 are displaced relative to each other. With this, the tip end-side portion of the convex spherical portion 14*b* separates from the bottom surface of the accommodating portion 15*a*, and therefore, a gap 21*a* is formed between the tip end-side portion of the convex spherical portion 14*b* and the bottom surface of the accommodating portion 15*a*. The gap 21*a* expands as the bottom surface of the accommodating portion 15*a* separates from the convex spherical portion 14*b*. The gap 21*a* communicates with the cylinder chamber 20 through the communication passage 14*c*. When the bottom surface of the accommodating portion 15*a* separates from the convex spherical portion 14*b*, and therefore, the gap 21*a* expands, the operating liquid in the cylinder chamber 20 is sucked up to the gap 21*a* through the communication passage 14*c* (see a mesh-like pattern in FIG. 5B). The gap 21*a* keeps on expanding until the base end-side portion of the convex spherical portion 14*b* engages with the opening end portion 15*d* of the shoe 15. During this time, the suck-up of the operating liquid continues. When the base end-side portion of the convex spherical portion 14*b* engages with the opening end portion 15*d* of the shoe 15, and therefore, the expansion of the gap 21*a* stops, the suck-up of the operating liquid stops.

Figure 6A:
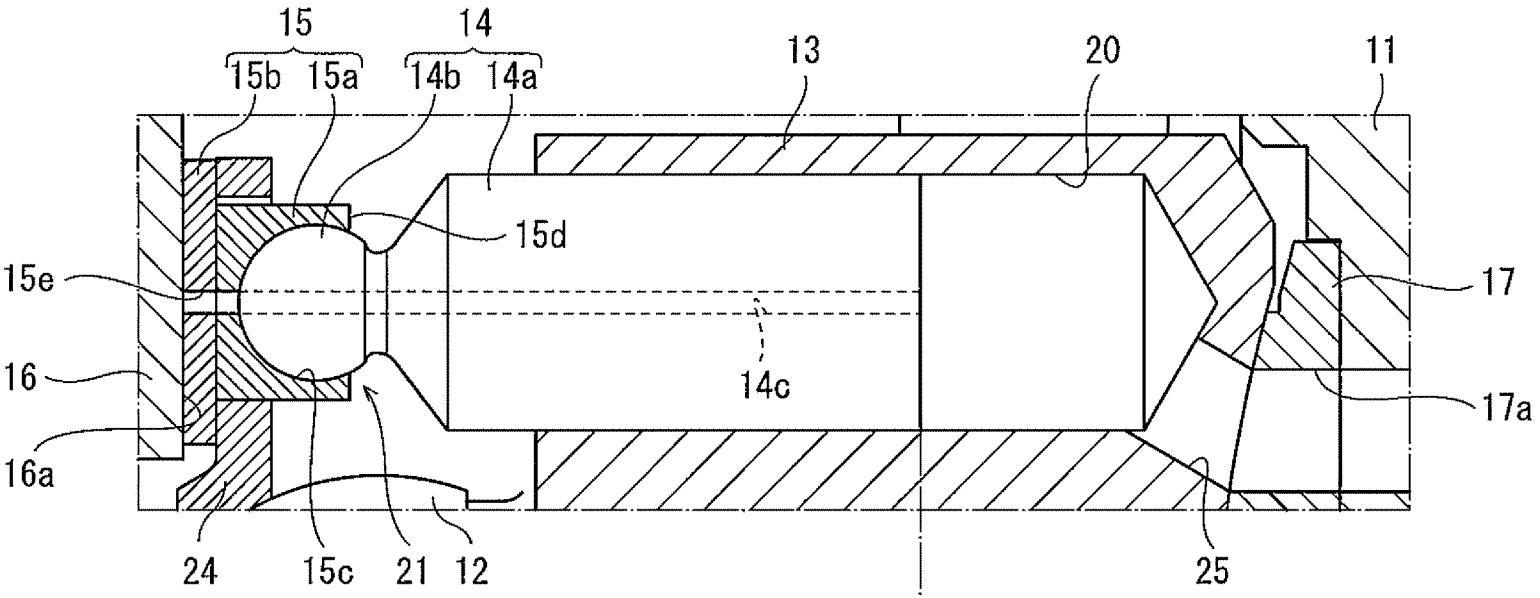
FIGS. 6A and 6B are sectional views showing the piston that is viewed from above and has moved to an intermediate point between the top dead center and the bottom dead center in the swash plate pump of FIG. 1.
Figure 6B:
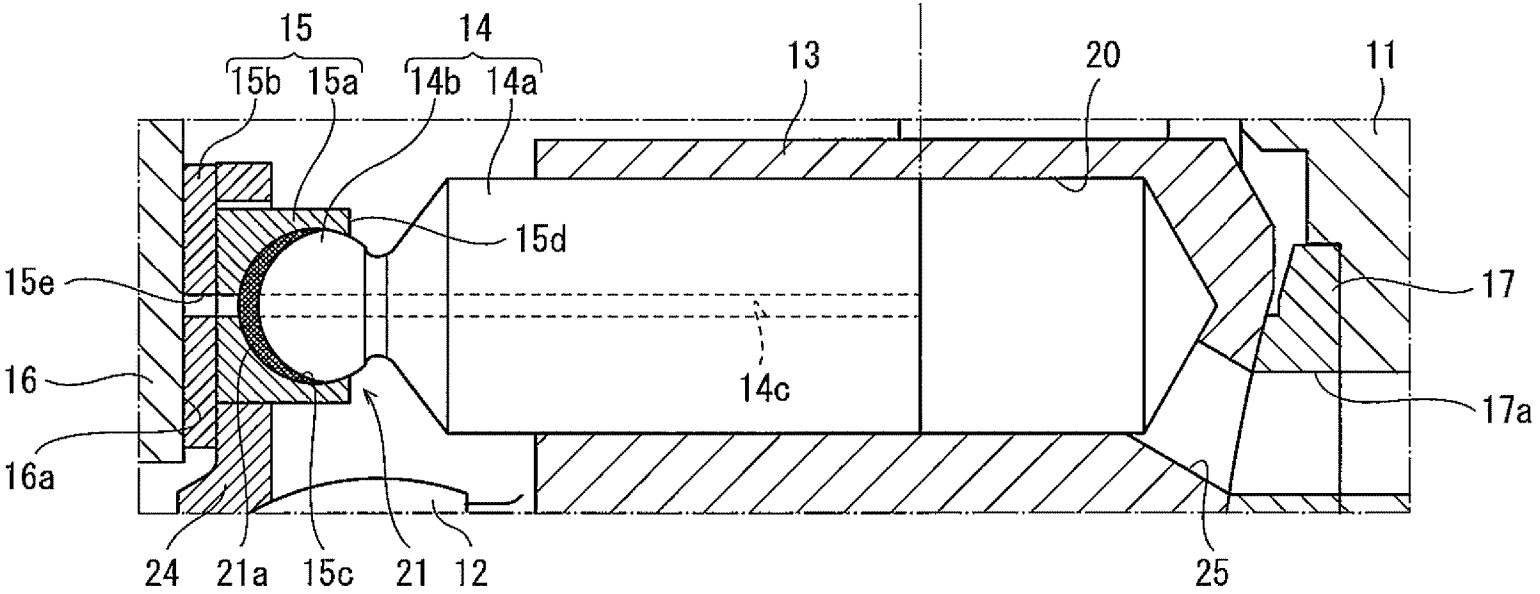
Figure 7A:
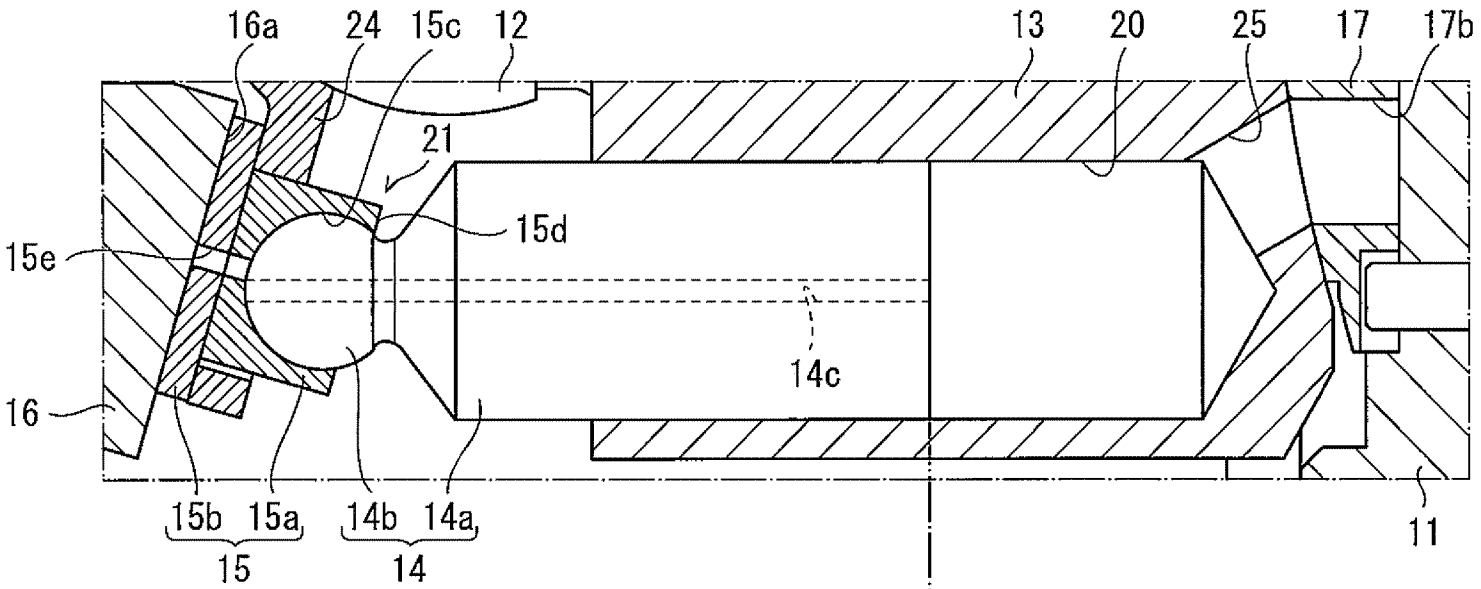
FIGS. 7A and 7B are sectional views showing the piston that is viewed from a lateral side and has reached the bottom dead center in the swash plate pump of FIG. 1.
Figure 7B:
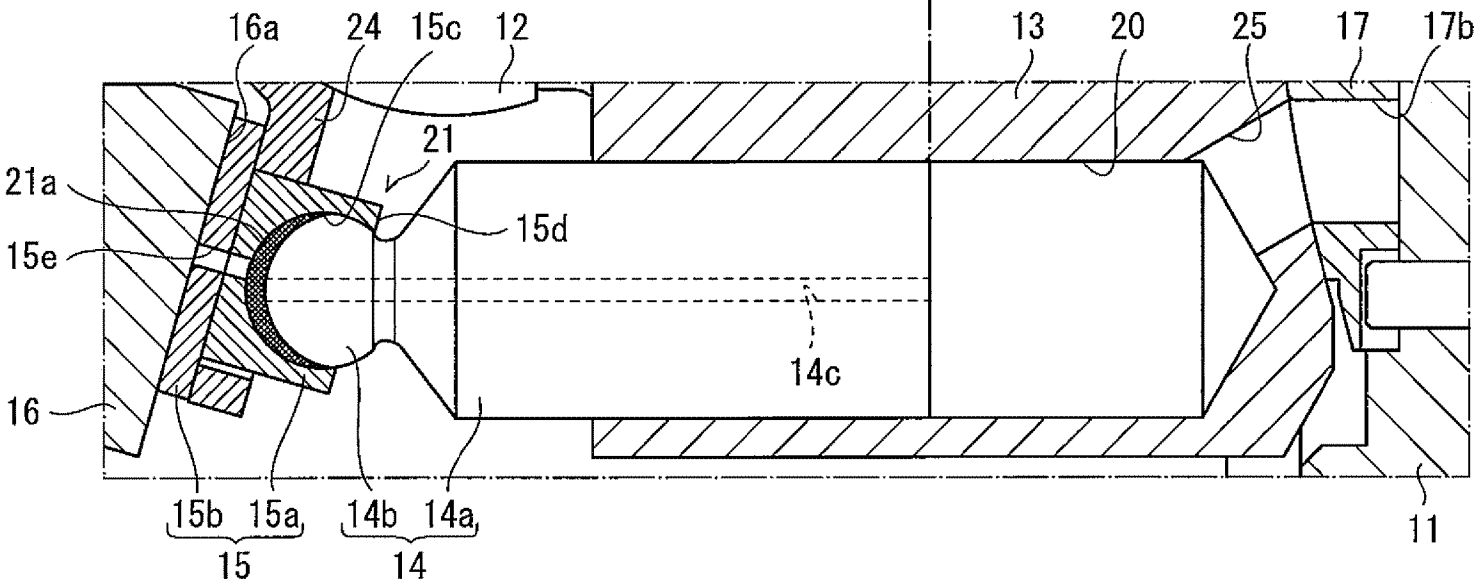
Figure 8A:
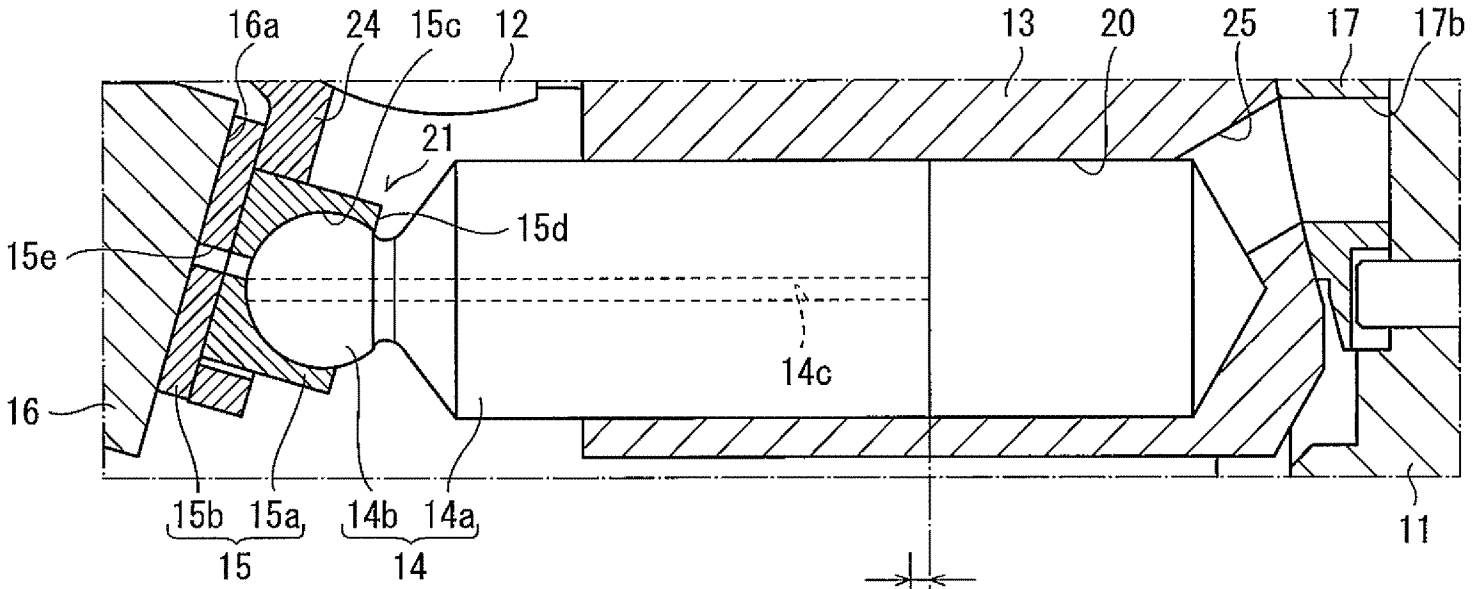
FIGS. 8A and 8B are sectional views showing the piston that is viewed from a lateral side and has slightly moved from the bottom dead center toward the top dead center in the swash plate pump of FIG. 1.
Figure 8B:
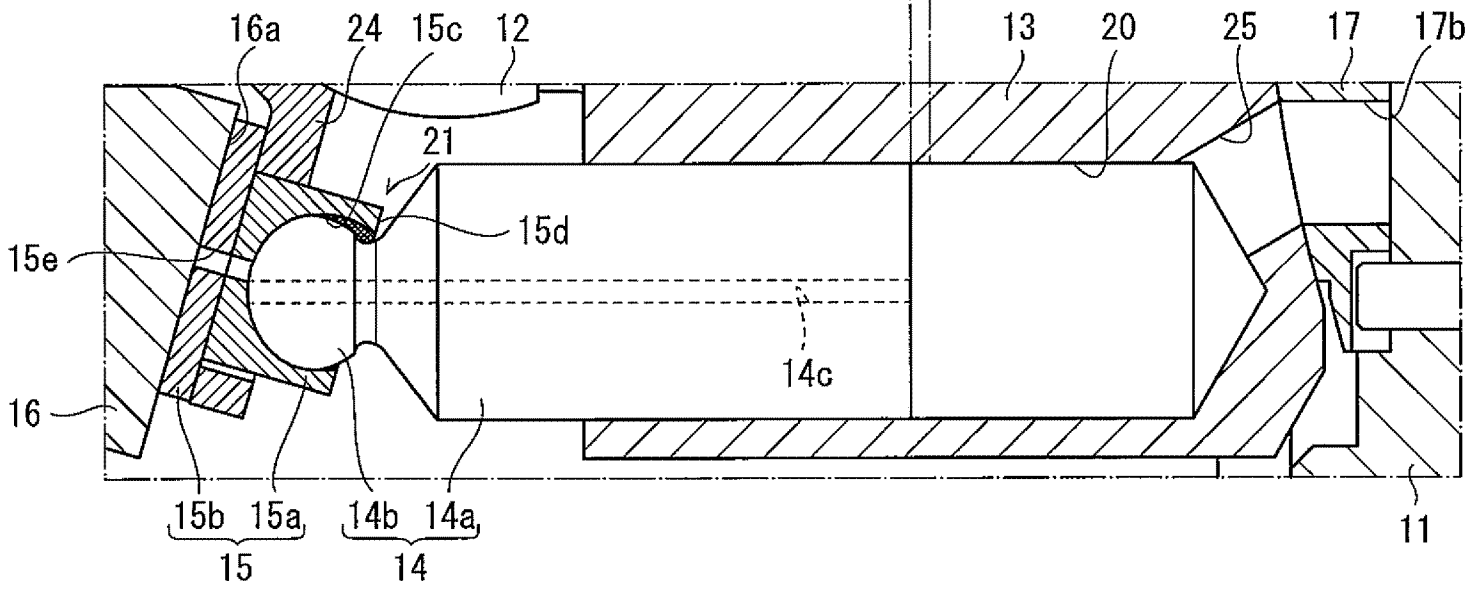

After the base end-side portion of the convex spherical portion 14*b* engages with the opening end portion 15*d* of the shoe 15, and therefore, the suck-up of the operating liquid stops, as shown in FIGS. 6A and 6B, the piston 14 is pulled by the shoe 15 to rotate from the vicinity of the top dead center toward the bottom dead center while retreating. Then, as shown in FIGS. 7A and 7B, the piston 14 reaches the bottom dead center, and when the piston 14 passes through the bottom dead center, the piston 14 starts rotating toward the top dead center. After the piston 14 passes through the bottom dead center, the shoe 15 is pushed forward by the swash plate 16. When there is no abnormality, the piston 14 advances in accordance with the movement of the shoe 15 that is pushed forward. To be specific, the operation of the piston 14 is switched from the retreating operation to the advancing operation (see FIG. 8A). On the other hand, when there is the abnormality, the gap 21*a* is formed between the tip end portion of the convex spherical portion 14*b* and the bottom surface of the accommodating portion 15*a*. Therefore, the shoe 15 cannot push the piston 14, and as with when the suction stroke starts, the piston 14 relatively remains stationary in the cylinder chamber 20. After that, until the shoe 15 advances along the swash plate 16, and the bottom surface of the accommodating portion 15*a* contacts the tip end-side portion of the convex spherical portion 14*b*, the piston 14 remains stationary. Then, as shown in FIG. 8B, when the tip end-side portion of the convex spherical portion 14*b* contacts the bottom surface of the accommodating portion 15*a*, the tip end-side portion of the convex spherical portion 14*b* is pushed by the bottom surface of the accommodating portion 15*a*, and the piston 14 starts advancing in the cylinder chamber 20 to rotate to the top dead center. Therefore, at the top dead center, the piston 14 having the abnormality is located at a rear side of the piston 14 having no abnormality by Δd (see FIGS. 2A and 2B). As above, in the swash plate pump 2, when there is the abnormality, in the discharge stroke as with the suction stroke, a time lag is generated between a timing at which the shoe 15 advances and a timing at which the piston 14 advances, i.e., a time lag is generated between a timing at which the piston 14 starts moving from the bottom dead center to the top dead center and a timing at which the piston 14 starts advancing.

Figure 9:
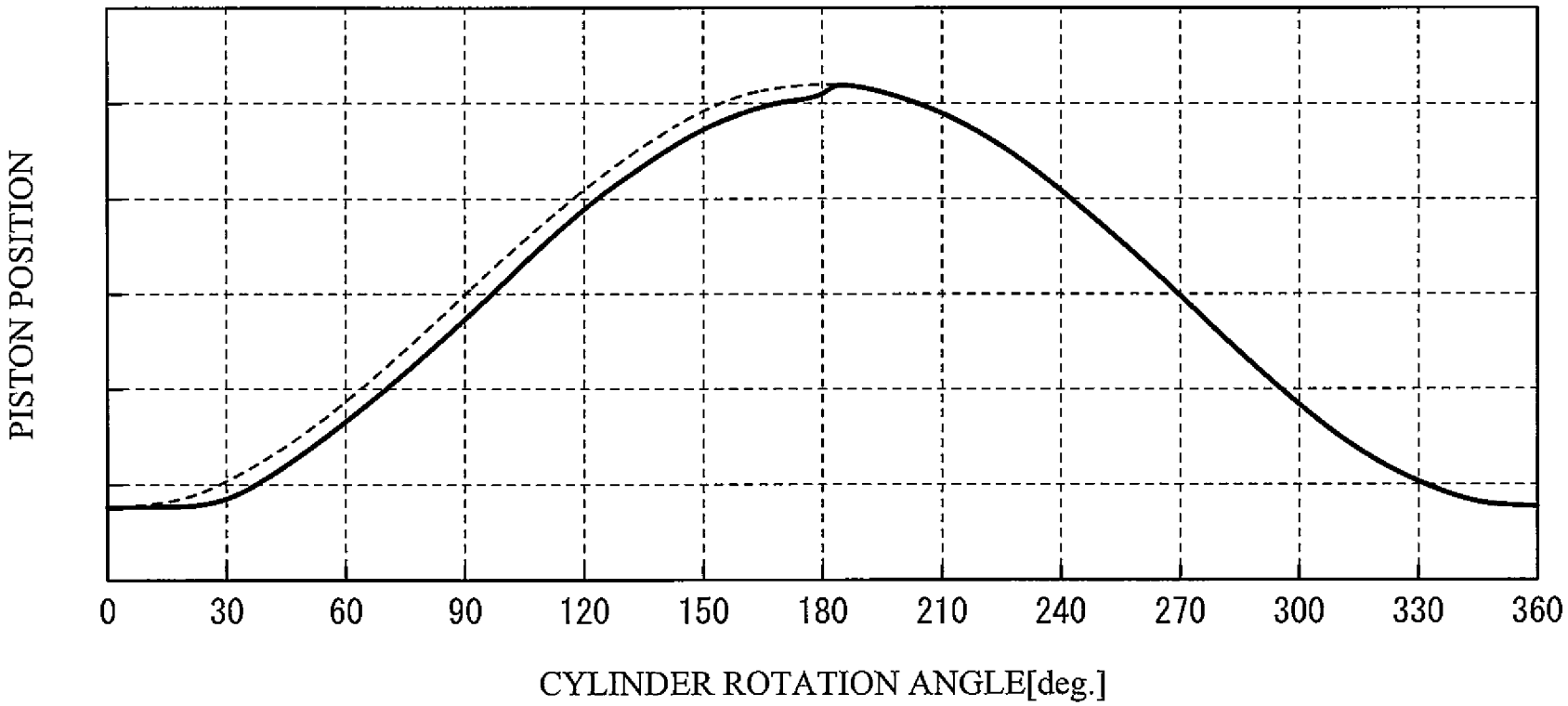
FIG. 9 is a graph showing a relation between a rotation angle of a cylinder block and an axial position of the piston in the swash plate pump of FIG. 1.
Figure 10:
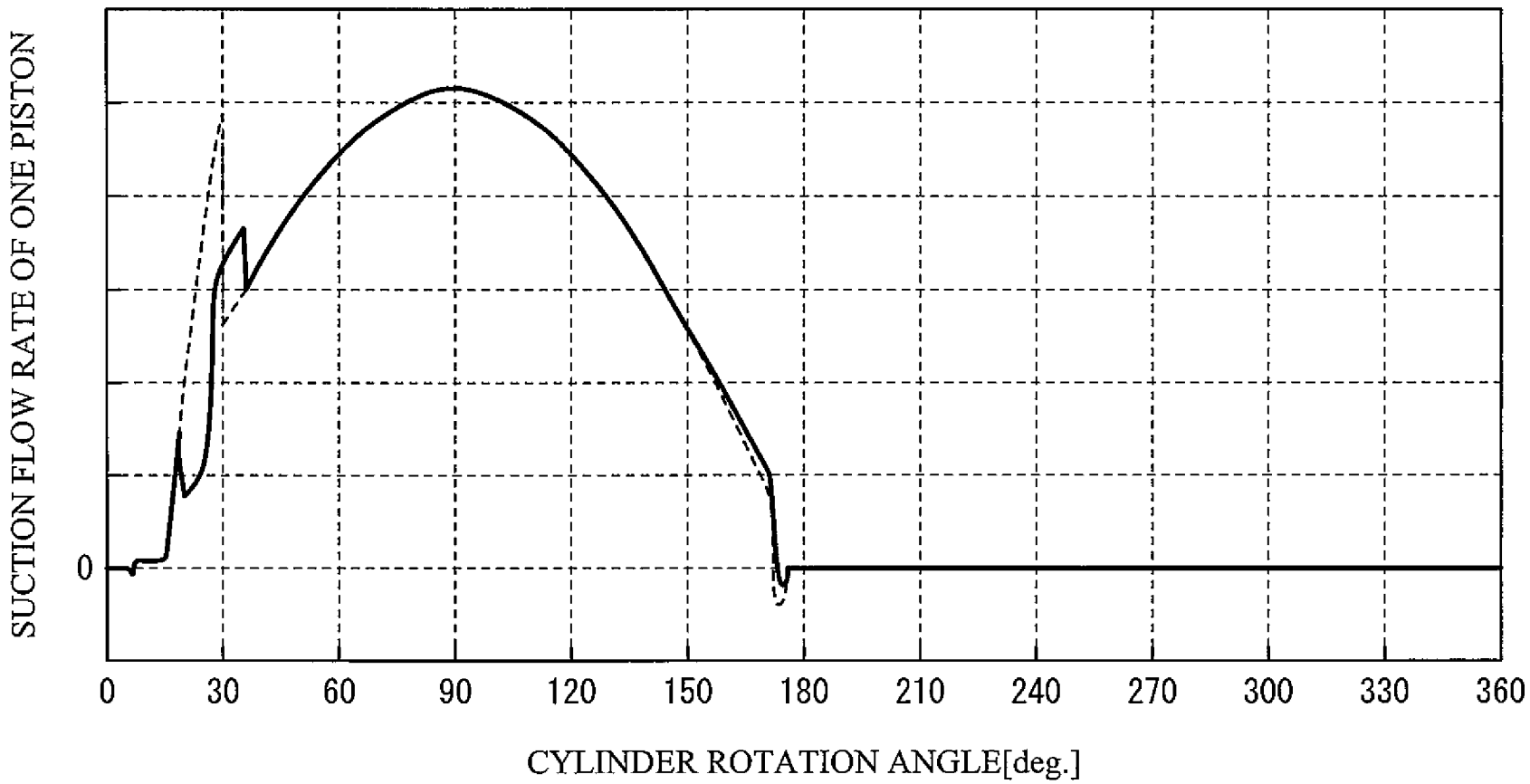
FIG. 10 is a graph showing a relation between the rotation angle of the cylinder block and a suction flow rate of one piston in the swash plate pump of FIG. 1.

In the swash plate pump 2 configured to operate as above, when there is no abnormality, as shown by a dotted line in FIG. 9, the piston 14 starts retreating largely while a rotation angle is between 15° and 30°. In FIG. 9, a vertical axis denotes the position of the piston 14 in the cylinder chamber 20, and a horizontal axis denotes the rotation angle [deg.] of the cylinder block 13. The top dead center corresponds to the rotation angle of 0°, and the bottom dead center corresponds to the rotation angle of 180°. On the other hand, when there is the abnormality, as shown by a solid line in FIG. 9, the piston 14 does not retreat largely and remains substantially stationary while the rotation angle is between 15° and 30° after the start of the movement from the top dead center to the bottom dead center. Therefore, as shown in FIG. 10, the suction flow rate of one piston 14 having no abnormality and the suction flow rate of one piston 14 having the abnormality are totally different from each other while the rotation angle is between 15° and 30°. In FIG. 10, a vertical axis denotes the suction flow rate of one piston 14, and a horizontal axis denotes the rotation angle [deg.] of the cylinder block 13. In FIG. 10, a dotted line shows the suction flow rate of the piston 14 having no abnormality, and a solid line shows the suction flow rate of the piston 14 having the abnormality.

Figure 12A:
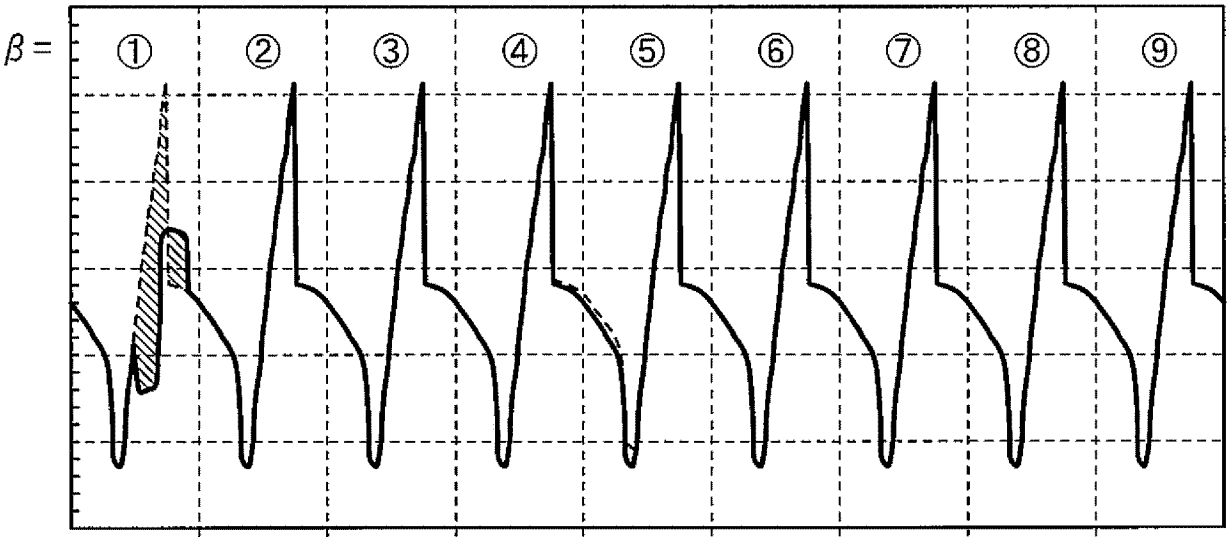
FIG. 12A is a graph showing a time-lapse change of the suction flow rate.
Figure 13A:
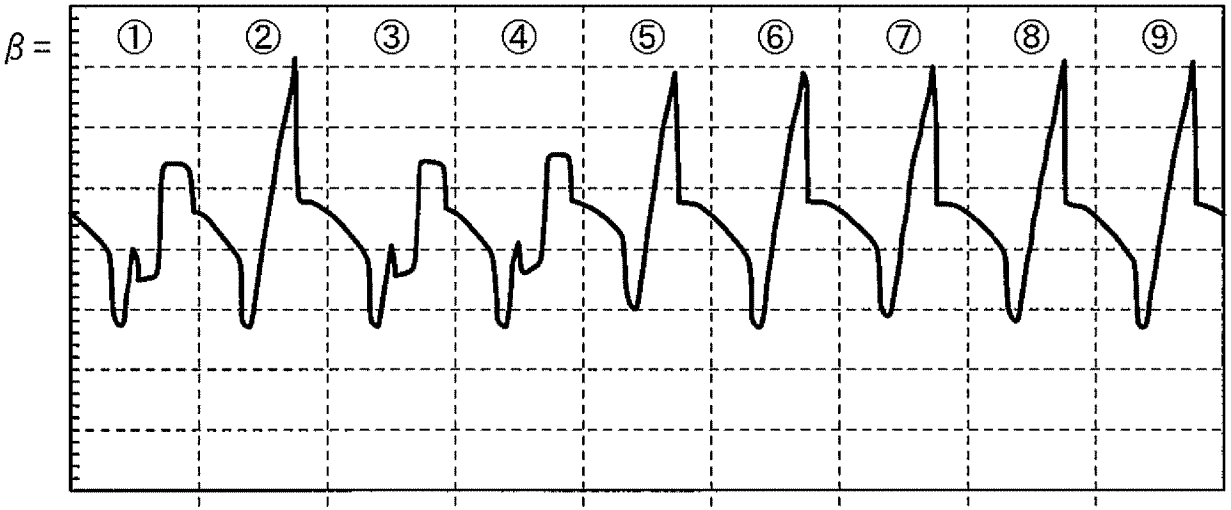
FIG. 13A is a graph showing a time-lapse change of the suction flow rate.
Figure 13B:
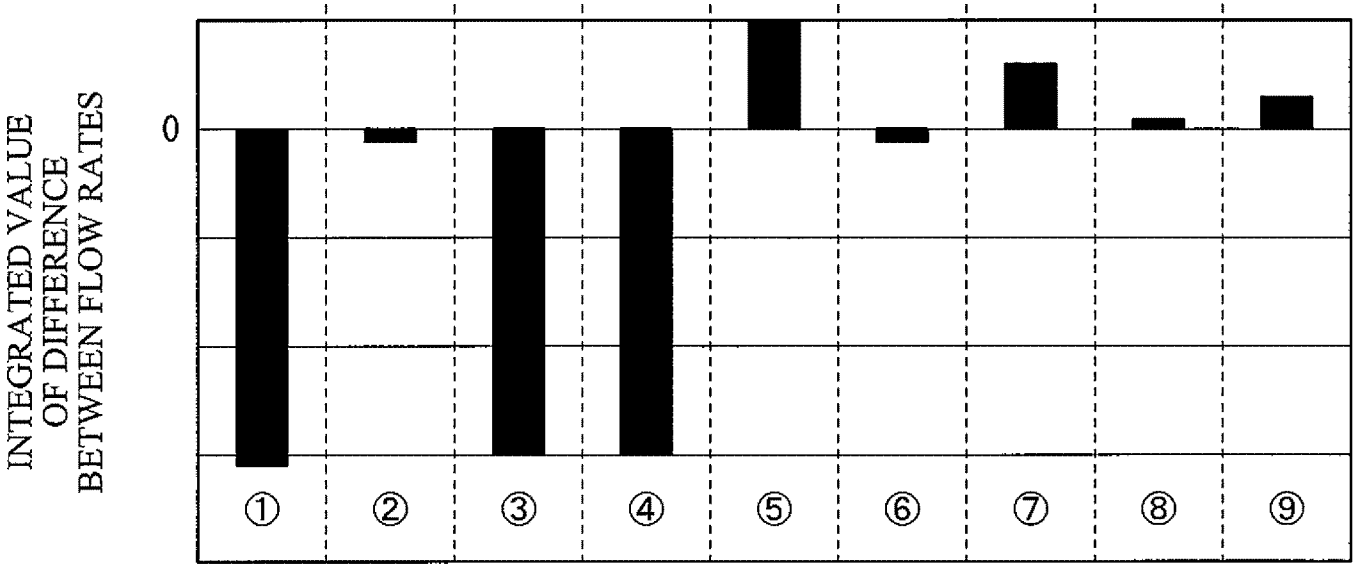
FIG. 13B is a graph showing a time-lapse change of an integrated value of a difference between the suction flow rates.

As above, the movement of the piston 14 changes by the presence or absence of the abnormality, and this changes the suction flow rate of one piston 14, i.e., this decreases the suction flow rate of one piston 14. In the swash plate pump 2, four or five cylinder chambers 20 are connected to the inlet port 17*a* at all times. The decrease in the suction flow rate of the piston 14 due to the generation of the abnormality appears also in the suction flow rate of the swash plate pump 2 (i.e., a total flow rate of the operating liquid sucked by all the pistons 14 connected to the inlet port 17*a*) as shown in FIG. 12A. In FIG. 12A, a vertical axis denotes the suction flow rate of the swash plate pump 2, and a horizontal axis denotes an elapsed time. Further, a solid line in FIG. 12A shows the actual waveform data, and a dotted line in FIG. 12A shows the reference waveform data. As above, the suction flow rates of the pistons 14 differ depending on the presence or absence of the abnormality. Therefore, the presence or absence of the abnormality can be determined by detecting the suction flow rate of the swash plate pump 2 and examining the time-lapse change (i.e., the history) of the suction flow rate.

In the swash plate pump 2, as described above, the position of the piston 14 at the top dead center changes depending on the presence or absence of the abnormality and moves toward the swash plate 16 in accordance with the size of the gap 21*a* (i.e., the looseness amount). Therefore, as the looseness amount increases, a time in which the piston 14 remains stationary during the movement from the top dead center to the bottom dead center increases, and the amount (i.e., suction amount) of operating liquid sucked into the cylinder chamber 20 through the inlet port 17*a* decreases. On this account, the looseness amount can be estimated by calculating a decrease amount of the suction amount. It should be noted that actually, the gap 21*a* is formed by the generation of the abnormality as described above, and at the same time, the suck-up of the operating liquid to the gap 21*a* occurs. Therefore, an actual decrease amount of the suction amount of operating liquid sucked by the piston 14 is a difference obtained by subtracting an increase amount of the suction amount by the suck-up of the operating liquid from a decrease amount of the suction amount due to a decrease in a retreat amount. When estimating the looseness amount, the looseness amount is calculated based on this difference. The retreat amount and the volume of the gap 21*a* correspond to the looseness amount, and the difference also corresponds to the looseness amount. Further, the above difference corresponds to a difference obtained by subtracting the suction amount of the piston 14 having the abnormality from the suction amount of the piston 14 having no abnormality. Therefore, the looseness amount can be estimated by calculating the difference between the suction amount of the piston 14 having the abnormality and the suction amount of the piston 14 having no abnormality.

Figure 11:
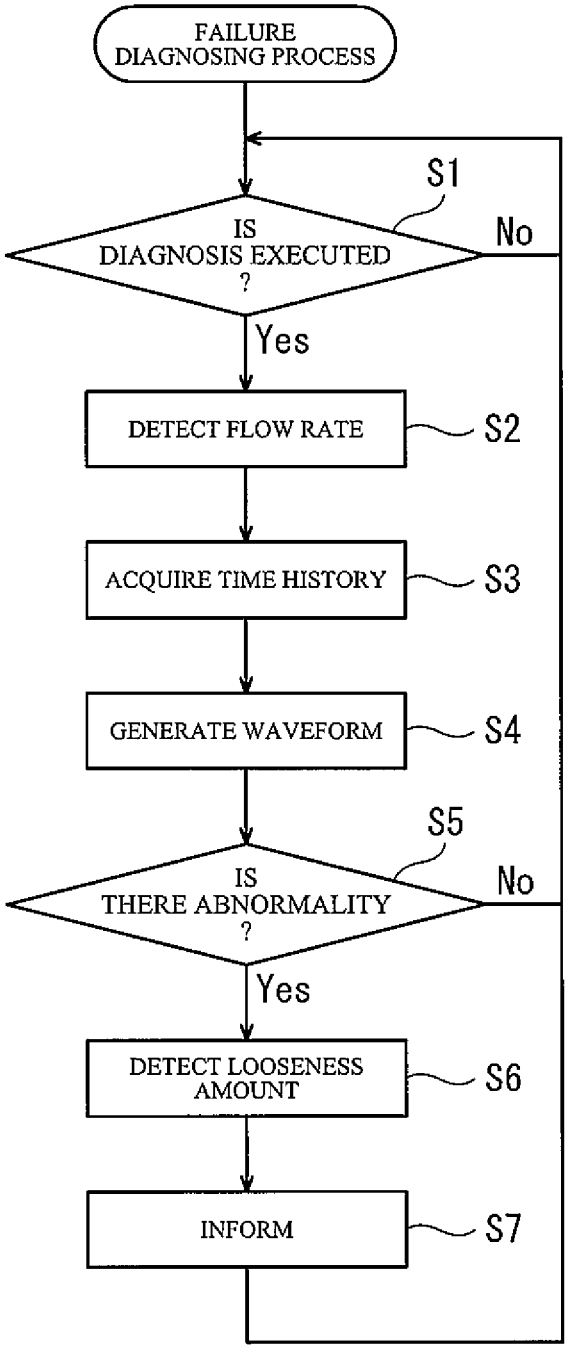
FIG. 11 is a flow chart showing a procedure of a failure diagnosing process executed by the failure diagnosing device in Embodiments 1 to 3.

As above, in the swash plate pump 2, the suction flow rates of the pistons 14 differ depending on the presence or absence of the abnormality, and the actual waveform data is made different from the reference waveform data by this difference. Therefore, the presence or absence of the abnormality in the swash plate pump 2 can be detected by comparing the reference waveform data with the actual waveform data. Further, since the difference between the suction amount of the piston 14 having the abnormality and the suction amount of the piston 14 having no abnormality corresponds to the looseness amount, the looseness amount can also be detected by calculating the difference between the suction amounts in the swash plate pump 2 based on the reference waveform data and the actual waveform data. Hereinafter, a procedure of a failure diagnosing process in which the failure diagnosing device 3 determines the presence or absence of the abnormality and detects the looseness amount will be described with reference to a flow chart of FIG. 11.

Failure Diagnosing Process

In the pump unit 1, when the rotating shaft is driven to rotate by the prime mover, and electric power is supplied to the failure diagnosing device 3, the failure diagnosing process is executed to proceed to Step S1. In Step S1 that is a diagnosis execution determining step, whether to execute failure diagnosis is determined. In the pump unit 1, the failure diagnosis is executed at predetermined diagnosis intervals, for example. Whether to execute the failure diagnosis is determined in accordance with a time elapsed since the termination of the previous failure diagnosis. The failure diagnosis does not necessarily have to be executed at the diagnosis intervals. Whether to execute the failure diagnosis may be instructed by an operating device, such as an operation panel or a switch. In this case, whether to execute the failure diagnosis is determined in accordance with the presence or absence of the instruction from the operating device. When it is determined that the failure diagnosis is not executed, the determination is repeatedly performed until the elapsed time satisfies a condition. On the other hand, when it is determined that the failure diagnosis is executed, the process proceeds to Step S2.

In Step S2 that is a flow rate detecting step, the flow rate calculating portion 31 detects the suction flow rate of the swash plate pump 2 based on the signals output from the sensor device 5. The storage portion 32 stores the detected suction flow rate together with a time when the suction flow rate is detected. After the suction flow rate is stored in the storage portion 32 together with the time, the process proceeds to Step S3. It should be noted that even after the process proceeds to Step S3, the suction flow rate may be repeatedly detected and stored.

In Step S3 that is a time history acquiring step, the history acquiring portion 33 acquires the actual history data in the diagnosis period. To be specific, among a plurality of actual suction flow rates stored in the storage portion 32, the history acquiring portion 33 acquires a plurality of actual suction flow rates stored in the predetermined diagnosis period. The acquired suction flow rates are the actual suction flow rates stored from a time when the suction flow rate is detected most recently until a time returned back therefrom by the cycle T. The history acquiring portion 33 acquires the plurality of actual suction flow rates in association with their detected times and creates the actual time history. After the actual time history is created, the process proceeds to Step S4. In Step S4 that is a waveform data generating step, the history acquiring portion 33 generates the actual waveform data based on the actual time history created in Step S3. More specifically, the plurality of actual suction flow rates in the actual time history are plotted at respective times associated with the actual suction flow rates. Thus, the actual waveform data shown by a solid line in FIG. 12A is generated. After the actual waveform data is generated, the process proceeds from Step S4 to Step S5.

In Step S5 that is a failure detecting step, the presence or absence of the generation of the abnormality is determined based on the actual waveform data generated by the history acquiring portion 33 and the reference waveform data stored in the storage portion 32. More specifically, as shown by the dotted line in FIG. 12A, the time history waveform data of the suction flow rate of the swash plate pump 2 pulsates in the diagnosis period at a cycle corresponding to the number $\alpha$ (in the present embodiment, $\alpha$=9) of pistons 14 included in the swash plate pump 2. To be specific, the time history waveform data of the suction flow rate of the swash plate pump 2 pulsates at a cycle T/$\alpha$ obtained by dividing the cycle T by the number $\alpha$ of pistons 14. Therefore, the number of mountain parts formed in the reference waveform data is $\alpha$, and these mountain parts are substantially the same in shape as one another. On the other hand, when at least one of the pistons 14 in the swash plate pump 2 has the abnormality, an influence of the decrease in the suction flow rate by the abnormality appears in the actual waveform data. Therefore, as shown by the solid line in FIG. 12A, in the actual waveform data, one of the $\alpha$ mountain parts is different in shape from the other mountain parts. The failure detecting portion 34 compares the reference waveform data with the actual waveform data in order to detect whether or not the actual waveform data contains such different shape. For example, the following method is used as such comparing method.

To be specific, the decrease in the suction flow rate due to the abnormality of the piston 14 mainly occurs immediately after the start of the suction (specifically, while the rotation angle is between the top dead center and about 360/$\alpha$ degrees). This decrease in the suction flow rate occurs each time the rotating shaft 12 rotates once (i.e., at the cycle T). The pistons 14 are arranged at the cylinder block 13 at intervals of about 360/$\alpha$ degrees in the circumferential direction of the cylinder block 13. When the rotating shaft 12 is rotated, the pistons 14 start sucking the operating liquid in order for about every 360/$\alpha$ degrees. Therefore, the decrease in the suction flow rate due to the abnormality of the piston 14 independently appears almost without influencing the suction flow rates of the swash plate pump 2 with each other. Further, since the cycle of the mountain part in the time history waveform data of the swash plate pump 2 is T/$\alpha$, the decrease in the suction flow rate due to the abnormality of the piston 14 appears only at the corresponding mountain part of the piston 14. For example, if only one of the nine pistons 14 has the abnormality, as shown by the solid line in FIG. 12A, only one mountain part is different in shape from the mountain part of the reference waveform data. Further, if three of the nine pistons 14 have the abnormalities, as shown by the solid line in FIG. 13A, three mountain parts are different in shape from the mountain parts of the reference waveform data.

Based on this, when comparing the reference waveform data with the actual waveform data, the failure detecting portion 34 divides each of the actual waveform data and the reference waveform data into sections corresponding to the number of mountain parts (i.e., each of the actual waveform data and the reference waveform data is divided into sections corresponding to the number $\alpha$ of pistons 14). Then, the failure detecting portion 34 compares a $\beta$-th mountain part ($\beta$=1 to $\alpha$) of the reference waveform data with a $\beta$-th mountain part ($\beta$=1 to $\alpha$) of the actual waveform data regarding all the combinations and determines whether or not the $\beta$-th mountain parts in at least one of the combinations are different from each other. When the $\beta$-th mountain parts are different from each other, the failure detecting portion 34 determines that the piston(s) 14, the number of which corresponds to the number of mountain parts that are different from each other, have the abnormalities. Whether or not the $\beta$-th mountain parts are different from each other is determined by, for example, the following method.

To be specific, a difference between the $\beta$-th mountain part of the reference waveform data and the $\beta$-th mountain part of the actual waveform data is integrated. Next, whether or not the obtained integrated value exceeds a predetermined threshold is determined. To be specific, when the integrated value does not exceed the threshold regarding all the mountain parts of the actual waveform data, the failure detecting portion 34 determines that there is no point of difference between the reference waveform data and the actual waveform data, and there is no abnormality. On the other hand, when the integrated value exceeds the threshold regarding at least one of the mountain parts of the actual waveform data, the failure detecting portion 34 determines that there is the point of difference between the reference waveform data and the actual waveform data, and there is the abnormality. Further, when the integrated value exceeds the threshold regarding a plurality of mountain parts, the failure detecting portion 34 can determine the number of pistons 14 having the abnormalities and the number of shoes 15 having the abnormalities based on the number of mountain parts whose integrated values exceed the threshold. The presence or absence of the abnormality is determined as above. When it is determined that there is no abnormality, the process returns to Step S1. On the other hand, when it is determined that there is the abnormality, the process proceeds to Step S6.

In Step S6 that is a looseness amount detecting step, the looseness amount is detected based on the reference waveform data and the actual waveform data. More specifically, as described above, the decrease in the suction flow rate due to the abnormality of the piston 14 appears at the corresponding mountain part of the piston 14. Further, as described above, the looseness amount corresponds to a difference between the suction amount by the piston 14 having no abnormality and the suction amount by the piston 14 having the abnormality. Furthermore, the difference between the suction amount by the piston 14 having no abnormality and the suction amount by the piston 14 having the abnormality corresponds to the integrated value of the difference between the suction flow rates of the two mountain parts that are different from each other. Therefore, based on these correspondence relations, the looseness amount is detected from the integrated value calculated in Step S5. The looseness amount with respect to the integrated value can be geometrically calculated by a spherical diameter of the convex spherical portion 14*b* of the piston 14, a hole diameter of the accommodating space 15*c* of the shoe 15, and a hole diameter of the cylinder chamber 20. When the looseness amount is detected, the process proceeds to Step S7.

Step S7 that is an informing step informs of the presence of the abnormality at the piston 14 and the looseness amount. To be specific, the failure detecting portion 34 outputs an informing signal to the informing device 4. The informing device 4 informs of the presence of the abnormality of the piston 14 and the looseness amount by making a monitor display those. After the informing device 4 informs, the process returns to Step S1, and whether to execute the failure diagnosis is determined.

The failure diagnosing device 3 of the pump unit 1 configured as above can detect the abnormality based on the suction flow rate of the swash plate pump 2. A change in the suction flow rate of the swash plate pump 2 due to an external factor is smaller than a change in discharge pressure of the swash plate pump 2 due to an external factor, and influence on the suction flow rate of the swash plate pump 2 by the abnormality tends to appear significantly. Therefore, by detecting the abnormality based on the suction flow rate of the swash plate pump 2, the abnormality can be accurately detected, and the detection accuracy of the failure can be improved.

The failure diagnosing device 3 prestores the reference waveform data and can detect the generation of the abnormality by comparing the reference waveform data with the actual waveform data. Therefore, the generation of the abnormality can be detected accurately and easily. Further, since the failure diagnosing device 3 can detect the looseness amount, the failure of the swash plate pump 2 can be determined quantitatively, not qualitatively. Therefore, determinations regarding a replacement timing of the piston 14, the degree of the failure of the swash plate pump 2, and the like can be flexibly performed in accordance with the looseness amount.

Embodiment 2

The pump unit 1A according to Embodiment 2 is similar in configuration to the pump unit 1 according to Embodiment 1. Therefore, regarding the pump unit 1A of Embodiment 2, components different from the components of the pump unit 1 of Embodiment 1 will be mainly described. The same reference signs are used for the same components, and a repetition of the same explanation is avoided. The same is true for the pump units 1B to 1D of Embodiments 3 to 5.

As shown in FIG. 1, the pump unit 1A of Embodiment 2 includes the swash plate pump 2, a failure diagnosing device 3A, the informing device 4, and a sensor device 5A. The failure diagnosing device 3A is connected to the sensor device 5A in order to detect the suction flow rate. The sensor device 5A includes, for example, an ultrasound flow rate sensor and outputs a signal in accordance with the flow rate in the pipe 30, i.e., the suction flow rate. The output signal is input to the failure diagnosing device 3A. As with the failure diagnosing device 3 of Embodiment 1, the failure diagnosing device 3A includes a CPU, a ROM, a RAM, and the like. As shown in FIG. 4, the failure diagnosing device 3A includes a flow rate calculating portion 31A, the storage portion 32, the history acquiring portion 33, and a failure detecting portion 34A. The flow rate calculating portion 31A detects the suction flow rate of the swash plate pump 2 based on the signals from the sensor device 5A and stores the detected suction flow rate in the storage portion 32 in association with the time when the suction flow rate is detected. Further, the failure detecting portion 34A performs the failure diagnosis as below.

To be specific, the failure detecting portion 34A determines the presence or absence of the abnormality based only on the actual waveform data contained in the actual history data acquired by the history acquiring portion 33. Specifically, first, the failure detecting portion 34A divides the actual waveform data into sections (i.e., nine sections) corresponding to the number $\alpha$ of pistons 14 and takes out the mountain parts from the actual waveform data. Next, the failure detecting portion 34A compares the mountain parts (for example, the adjacent mountain parts or the first mountain part and the other mountain part) with each other to detect the presence or absence of the mountain part having a different shape. The failure detecting portion 34A detects the presence or absence of the mountain part having a different shape by, for example, integrating the difference between two mountain parts to be compared and determining whether or not the obtained integrated value exceeds a predetermined threshold. Further, the failure detecting portion 34A detects the looseness amount from the integrated value based on the correspondence relation between the integrated value and the looseness amount. As above, the failure detecting portion 34A can detect the generation of the abnormality only by the actual waveform data without comparing the actual waveform data with the reference waveform data unlike the failure detecting portion 34 of Embodiment 1.

As with the failure diagnosing device 3 of Embodiment 1, the failure diagnosing device 3A configured as above executes the failure diagnosing process when the rotating shaft is driven to rotate by the prime mover, and electric power is supplied to the failure diagnosing device 3. It should be noted that the failure diagnosing process executed by the failure diagnosing device 3A is similar to the diagnosis process of Embodiment 1. Hereinafter, regarding the failure diagnosing process executed by the failure diagnosing device 3A, steps different from the steps of the diagnosis process of Embodiment 1 will be described, and explanations of the same steps are omitted.

To be specific, in Step S5 that is the failure detecting step, first, the failure detecting portion 34A divides the actual waveform data into the mountain parts. Then, the failure detecting portion 34A compares the adjacent mountain parts with each other to determine whether or not there exists the different mountain part. To be specific, as described above, the failure detecting portion 34A integrates the difference between two mountain parts to be compared and determines whether or not the obtained integrated value exceeds a predetermined threshold. When the integrated value does not exceed the threshold regarding all the pulsations, the failure detecting portion 34A determines that all the mountain parts are substantially the same as one another as the waveform data, and there is no abnormality. On the other hand, when the integrated value exceeds the threshold regarding at least one of the mountain parts, the failure detecting portion 34A determines that there is the mountain part having a different shape, and there is the abnormality. The presence or absence of the abnormality is determined as above. When the failure detecting portion 34A determines that there is no abnormality, the process returns to Step S1. On the other hand, when the failure detecting portion 34A determines that there is the abnormality, the process proceeds to Step S6. Further, in Step S6 that is the looseness amount detecting step, based on the correspondence relation between the integrated value and the looseness amount, the failure detecting portion 34A detects the looseness amount from the integrated value calculated in Step S5. When the looseness amount is detected, the process proceeds to Step S7.

According to the pump unit 1A configured as above, the presence or absence of the abnormality can be accurately detected without the reference history data, and the failure diagnosing device 3A can be easily configured.

Other than the above, the pump unit 1A of Embodiment 2 has the same operational advantages as the pump unit 1 of Embodiment 1.

Embodiment 3

Figure 14A:
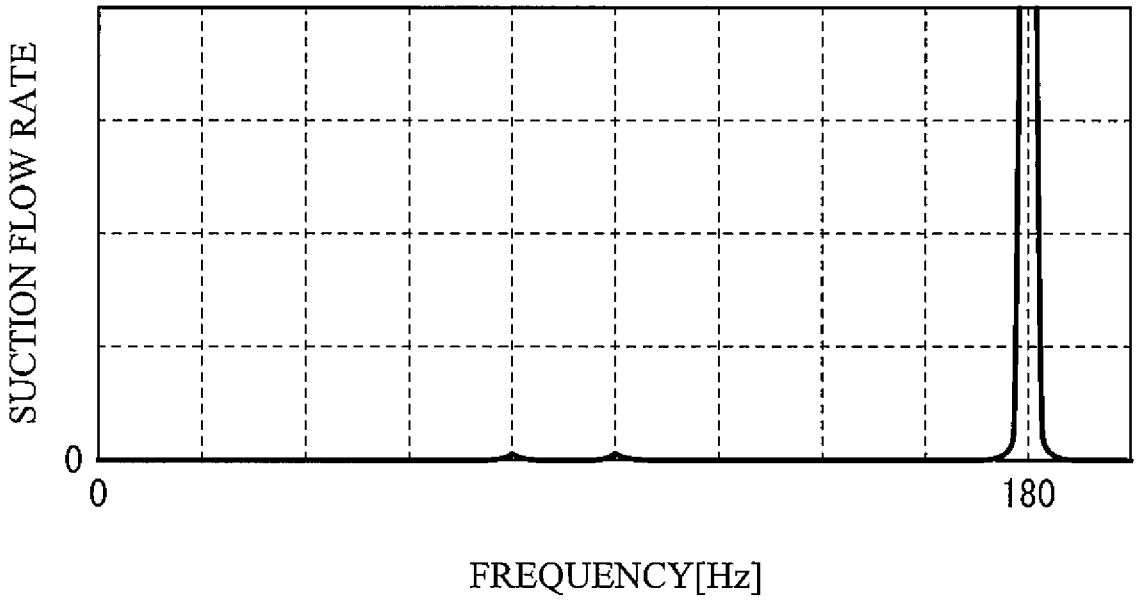
FIGS. 14A and 14B are graphs each showing a frequency spectrum of the suction flow rate of the swash plate pump.
Figure 14B:
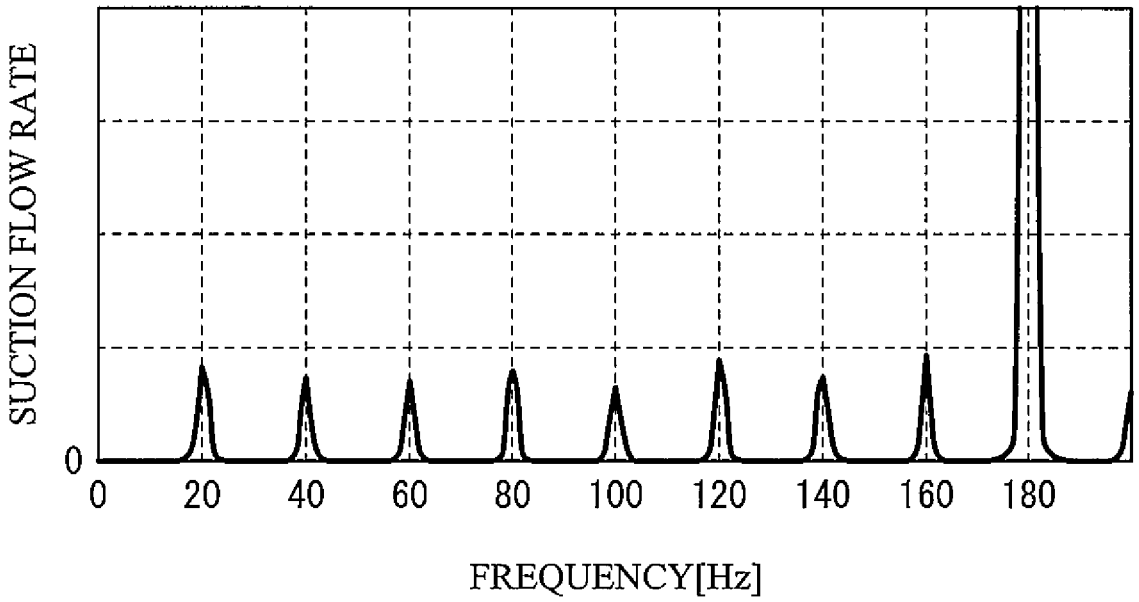

As shown in FIG. 1, the pump unit 1B of Embodiment 3 includes the swash plate pump 2, a failure diagnosing device 3B, the informing device 4, and the sensor device 5. As with the failure diagnosing device 3 of Embodiment 1, the failure diagnosing device 3B includes a CPU, a ROM, a RAM, and the like. As shown in FIG. 4, the failure diagnosing device 3B includes the flow rate calculating portion 31, the storage portion 32, the history acquiring portion 33, and a failure detecting portion 34B. The failure detecting portion 34B performs frequency analysis of the actual waveform data by FFT (fast Fourier transform) or the like, the actual waveform data being contained in the actual history data acquired by the history acquiring portion 33. When there is no abnormality regarding all the pistons 14 of the swash plate pump 2, as described above, the mountain parts that are the same in shape as one another appear in the time history waveform data of the suction flow rate at the cycle T/α. To be specific, in a frequency spectrum in this case, a component of a frequency α/T is mainly detected (see FIG. 14A). On the other hand, when there is the abnormality regarding one piston 14 of the swash plate pump 2, the mountain part having a different shape from the other mountain parts appears at every cycle T as shown in FIG. 14B. Therefore, in the frequency spectrum of the actual waveform data, a component of a frequency 1/T and components of multiples of the frequency 1/T are detected in addition to the component of the frequency α/T. On this account, the failure detecting portion 34B can detect the abnormality of the piston 14 based on the frequency spectrum of the actual waveform data by performing the frequency analysis of the actual waveform data to calculate the frequency spectrum. To be specific, the failure detecting portion 34B can detect the presence or absence of the abnormality based only on the actual waveform data.

According to the failure diagnosing device 3B configured as above, when the failure diagnosing process is executed, as described above, the failure detecting portion 34B performs the frequency analysis of the actual waveform data to calculate the frequency spectrum in Step S5 that is the failure diagnosis step. Further, the failure detecting portion 34B detects whether or not a component other than the component of the frequency α/T is present in the frequency spectrum. It should be noted that whether or not the component other than the component of the frequency α/T is present is determined based on whether or not the suction flow rate of each component exceeds a predetermined threshold. To be specific, when there is a component which is other than the component of the frequency α/T and exceeds the threshold, the failure detecting portion 34B determines that there is the abnormality. On the other hand, when there is no component which is other than the component of the frequency α/T and exceeds the threshold, the failure detecting portion 34B determines that there is no abnormality. The presence or absence of the abnormality is determined as above. When the failure detecting portion 34B determines that there is no abnormality, the process returns to Step S1. On the other hand, when the failure detecting portion 34B determines that there is the abnormality, the process proceeds to Step S7, and the presence of the abnormality is informed of in Step S7.

According to the pump unit 1B configured as above, the presence or absence of the abnormality can be accurately detected without the reference history data, and the failure diagnosing device 3 can be easily configured. It should be noted that the looseness amount may be detected based on the frequency spectrum although the failure diagnosing device 3B of the present embodiment does not detect the looseness amount. To be specific, in the swash plate pump 2, the mountain part of the frequency component corresponding to the looseness amount is contained in the actual waveform data, and the looseness amount can be detected based on the frequency component contained in the frequency spectrum and the magnitude of the frequency component.

Other than the above, the pump unit 1B of Embodiment 3 has the same operational advantages as the pump unit 1 of Embodiment 1.

Embodiment 4

Figure 15:
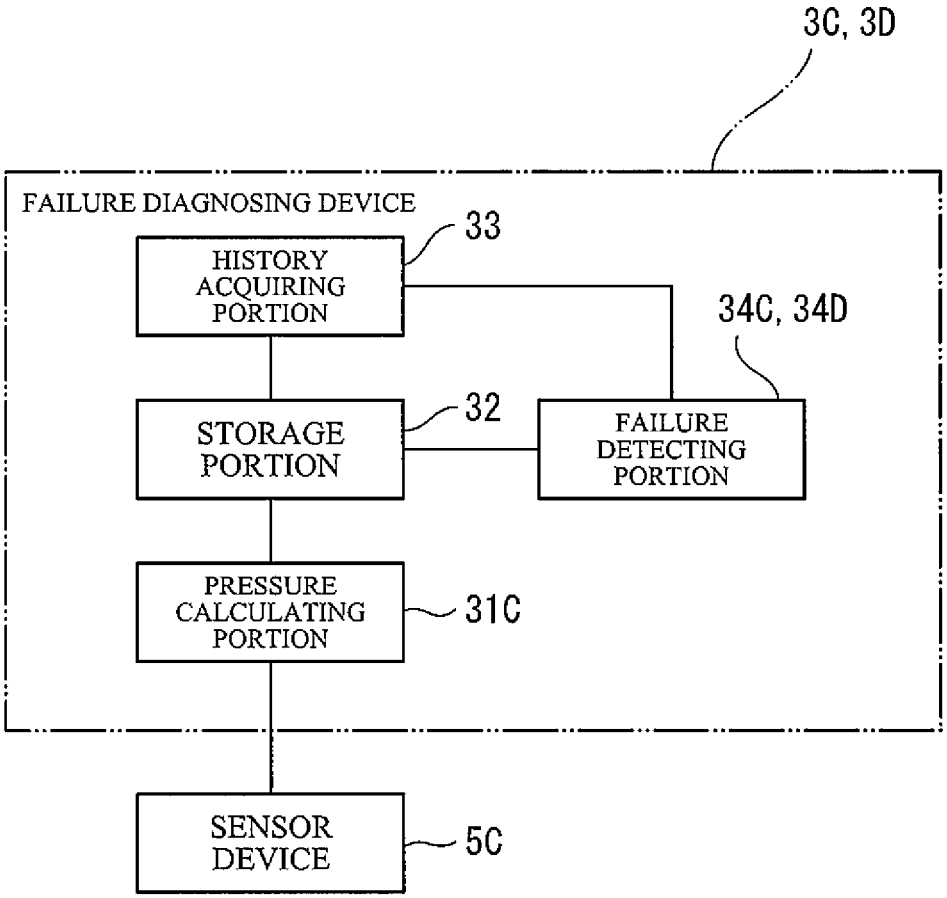
FIG. 15 is a block diagram showing the failure diagnosing device included in the pump unit in Embodiments 4 and 5.

As shown in FIG. 1, the pump unit 1C of Embodiment 4 includes the swash plate pump 2, a failure diagnosing device 3C, the informing device 4, and a sensor device 5C. As with the failure diagnosing device 3 of Embodiment 1, the failure diagnosing device 3C includes a CPU, a ROM, a RAM, and the like. As shown in FIG. 15, the failure diagnosing device 3C includes a pressure calculating portion 31C, the storage portion 32, the history acquiring portion 33, and a failure detecting portion 34C.

Failure Diagnosing Device

The failure diagnosing device 3C detects the generation of the failure of the swash plate pump 2, i.e., the generation of the abnormality based on the history of the suction pressure, i.e., the history of the pressure of the operating liquid sucked by the swash plate pump 2 in a predetermined period of time, such as in a period in which the cylinder block 13 rotates once. It should be noted that the history contains the time history and the time history waveform data. The time history of the suction pressure is history information indicating a time-lapse change of the suction pressure, and the time history waveform data is waveform data indicating the time-lapse change of the suction pressure. The failure diagnosing device 3C cooperates with the sensor device 5C to detect the suction pressure in order to detect the generation of the abnormality, and the failure diagnosing device 3C is connected to the sensor device 5C in order to detect the suction pressure. The sensor device 5C is a so-called pressure sensor and is provided on the pipe 30 connecting the inlet port 17*a* and the tank or the like. A signal detected by the sensor device 5C is input to the failure diagnosing device 3C.

The failure diagnosing device 3C calculates the suction pressure based on the signal input from the sensor device 5C and detects the generation of the abnormality based on the detected suction pressure. The pressure calculating portion 31C of the failure diagnosing device 3C is connected to the sensor device 5C and acquires the signals from the sensor device 5C at predetermined time intervals. Further, the pressure calculating portion 31C calculates the suction pressure based on the acquired signals. The suction pressure calculated as above is stored in the storage portion 32 in association with the detected time.

The storage portion 32 can store a plurality of suction pressures. The storage portion 32 stores the suction pressure (i.e., actual suction pressure), detected by the pressure calculating portion 31C, in association with a time when the suction pressure is detected. The history acquiring portion 33 acquires actual history data based on the plurality of actual suction pressures stored as above. The actual history data indicates a history in a predetermined diagnosis period. In the present embodiment, the diagnosis period is set to a cycle T[s] of the rotating shaft 12. The cycle T can be acquired by calculation based on a target rotational frequency of the rotating shaft 12 that rotates at a fixed rotational frequency or can be detected based on a signal from a rotation angle sensor (not shown), a rotation detector, or the like provided at the rotating shaft 12. More specifically, first, the history acquiring portion 33 acquires an actual time history based on the plurality of actual suction pressures stored in the storage portion 32. The actual time history is a time history in a predetermined diagnosis period. Then, based on the acquired actual history data, the history acquiring portion 33 creates time history waveform data (i.e., actual waveform data; see FIG. 17A described below). Further, the storage portion 32 stores the following information in association with the actual history data and the actual waveform data.

To be specific, the storage portion 32 stores reference history data. The reference history data contains a reference time history and its time history waveform data (reference waveform data). The reference time history corresponds to the actual time history and indicates a time-lapse change of reference suction pressure in a period that is substantially the same as the diagnosis period. The reference suction pressure is a suction pressure detected at an early stage in the swash plate pump 2, a suction pressure calculated in a master swash plate pump that is the same in type as the swash plate pump 2, or a suction pressure detected in a swash plate pump modeled in simulation. The reference suction pressure is suction pressure used as a determination criterion. The reference history data is created by detecting the reference suction pressure in the diagnosis period in advance. As with the actual waveform data, the reference waveform data is created by plotting the reference time history at respective times. The reference history data containing the reference time history and the reference waveform data is used by the failure detecting portion 34C together with the actual history data in order to detect the generation of the abnormality.

The failure detecting portion 34C detects the generation of the abnormality, i.e., the presence or absence of the abnormality based on the actual history data acquired by the history acquiring portion 33 and the reference history data stored in the storage portion 32. Specifically, first, the failure detecting portion 34C compares the actual waveform data contained in the actual history data with the reference waveform data contained in the reference history data. When there is a point of difference between the actual waveform data and the reference waveform data, the failure detecting portion 34C determines that there is the abnormality. Although details will be described later, the failure detecting portion 34C detects the presence or absence of the abnormality by the following method. To be specific, the failure detecting portion 34C integrates a difference between the suction pressures at the point of difference to calculate an integrated value. Then, when the integrated value is larger than a predetermined threshold, the failure detecting portion 34C determines that there is the abnormality.

The failure diagnosing device 3C configured as above determines the presence or absence of the generation of the abnormality based on the suction pressure by executing a below-described failure diagnosing process. Hereinafter, in order to clarify the reason why the generation of the abnormality can be detected based on the suction flow rate, a mechanism in which the suction pressure changes by the generation of the abnormality in the swash plate pump 2 will be described.

Relation Between Abnormality and Suction Pressure

Figure 17A:
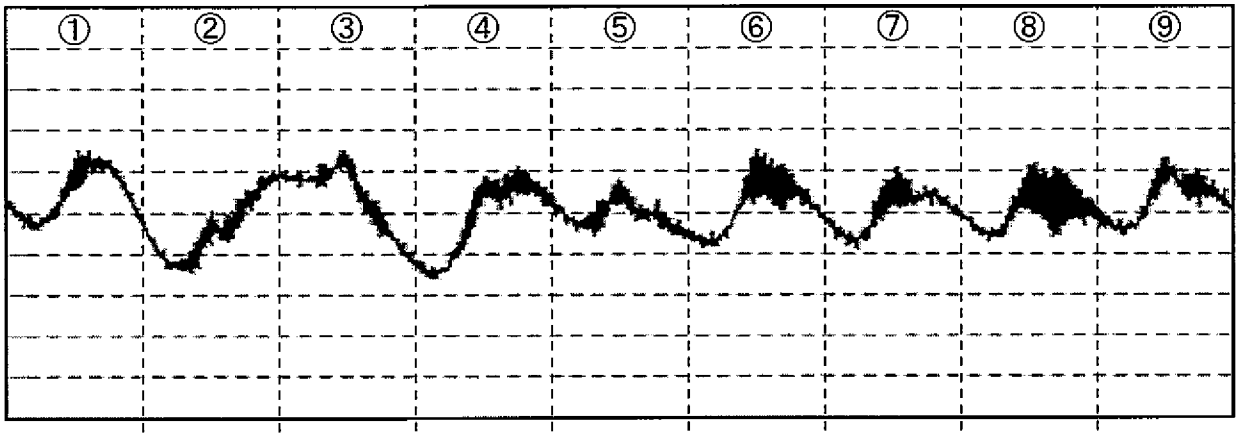
FIGS. 17A and 17B are graphs each showing a time-lapse change of suction pressure of the swash plate pump shown in FIG. 1.
Figure 17B:
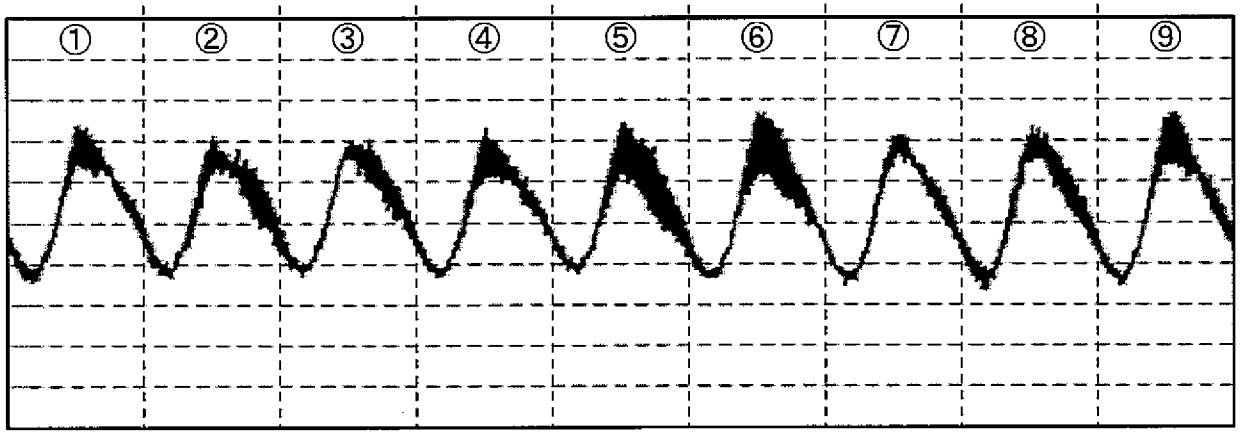

The mechanism in which the abnormality is generated between the piston 14 and the shoe 15 at the spherical joint portion 21 is described in Embodiment 1. In addition, as described in Embodiment 1, the movement of the piston 14 changes depending on the presence or absence of the abnormality, and this changes, i.e., decreases the suction flow rate of one piston 14. In the swash plate pump 2, four or five cylinder chambers 20 are connected to the inlet port 17*a* at all times. The decrease in the suction flow rate of the piston 14 due to the generation of the abnormality appears also in the suction flow rate of the swash plate pump 2 (i.e., a total flow rate of the operating liquid sucked by all the pistons 14 connected to the inlet port 17*a*). As above, the suction flow rates of the pistons 14 differ depending on the presence or absence of the abnormality. The suction flow rate of the swash plate pump 2 corresponds to the suction pressure of the swash plate pump 2. The suction pressure changes as the suction flow rate changes. For example, FIG. 17A is a graph showing the actual waveform data of the swash plate pump 2 having the abnormality. FIG. 17B is a graph showing the time history waveform data of the swash plate pump 2 having no abnormality, i.e., the reference waveform data. As above, as with the suction flow rates, the suction pressures differ depending on the presence or absence of the abnormality. The presence or absence of the abnormality can be determined by detecting the suction pressure of the swash plate pump 2 and examining the time-lapse change (i.e., the history) of the suction pressure. In FIGS. 17A and 17B, a vertical axis denotes the suction pressure of the swash plate pump 2, and a horizontal axis denotes an elapsed time.

Figure 16:
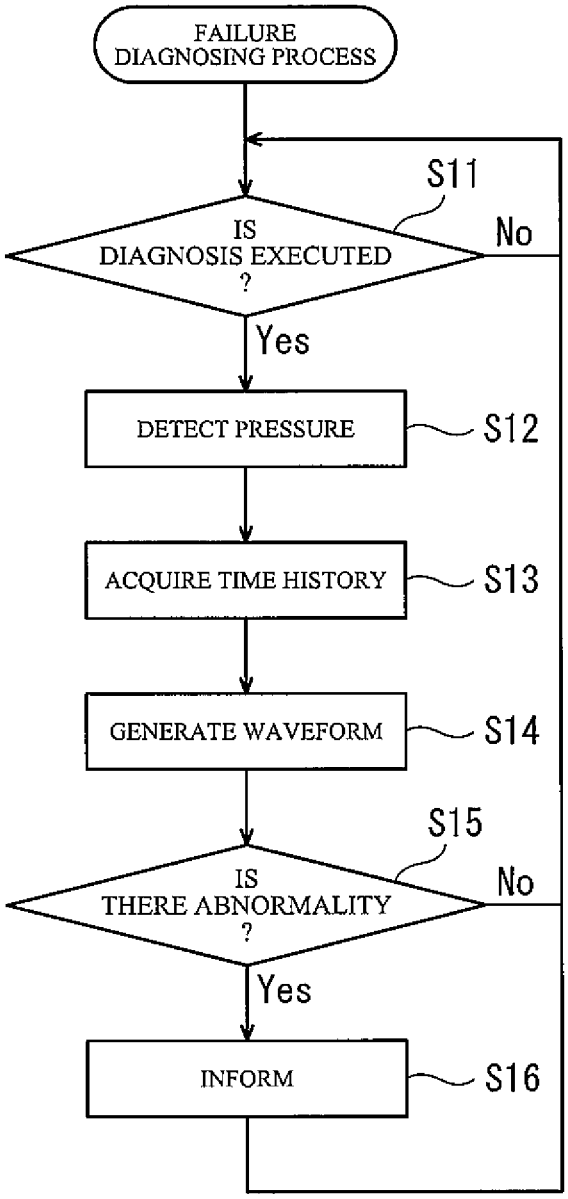
FIG. 16 is a flow chart showing a procedure of the failure diagnosing process executed by the failure diagnosing device in Embodiments 4 and 5.

As above, in the swash plate pump 2, the suction pressures of the pistons 14 differ depending on the presence or absence of the abnormality, and the actual waveform data is made different from the reference waveform data by this difference. Therefore, the generation of the abnormality in the swash plate pump 2 can be detected by comparing the reference waveform data with the actual waveform data. Hereinafter, a procedure of the failure diagnosing process in which the failure diagnosing device 3C detects the generation of the abnormality will be described with reference to the flow chart of FIG. 16.

Failure Diagnosing Process

In the pump unit 1C, when the rotating shaft is driven to rotate by the prime mover, and electric power is supplied to the failure diagnosing device 3C, the failure diagnosing process is executed to proceed to Step S11. In Step S11 that is the diagnosis execution determining step, whether to execute failure diagnosis is determined. In the pump unit 1C, the failure diagnosis is executed at predetermined diagnosis intervals, for example. Whether to execute the failure diagnosis is determined in accordance with a time elapsed since the termination of the previous failure diagnosis. The failure diagnosis does not necessarily have to be executed at the diagnosis intervals. Whether to execute the failure diagnosis may be instructed by an operating device, such as an operation panel or a switch. In this case, whether to execute the failure diagnosis is determined in accordance with the presence or absence of the instruction from the operating device. When it is determined that the failure diagnosis is not executed, the determination is repeatedly performed until the elapsed time satisfies a condition. On the other hand, when it is determined that the failure diagnosis is executed, the process proceeds to Step S12.

In Step S12 that is a pressure detecting step, the pressure calculating portion 31C calculates the suction pressure of the swash plate pump 2 based on the signals output from the sensor device 5C. The storage portion 32 stores the detected suction pressure together with a time when the suction pressure is detected. After the suction pressure is stored in the storage portion 32 together with the time, the process proceeds to Step S13. Even after the process proceeds to Step S13, the suction pressure may be repeatedly detected and stored.

In Step S13 that is the time history acquiring step, the history acquiring portion 33 acquires the actual history data in the diagnosis period. To be specific, among a plurality of actual suction pressures stored in the storage portion 32, the history acquiring portion 33 acquires a plurality of actual suction pressures stored in the predetermined diagnosis period. The acquired suction pressures are the actual suction pressures stored from a time when the suction pressure is detected most recently until a time returned back therefrom by the cycle T. The history acquiring portion 33 acquires the plurality of actual suction pressures in association with their detected times and creates the actual time history. After the actual time history is created, the process proceeds to Step S14. In Step S14 that is a waveform generating step, the history acquiring portion 33 generates the actual waveform data based on the actual time history created in Step S13. More specifically, the plurality of actual suction pressures in the actual time history are plotted at respective times associated with the actual suction pressures. Thus, the actual waveform data shown in FIG. 17A is generated. After the actual waveform data is generated, the process proceeds from Step S14 to Step S15.

In Step S15 that is the failure detecting step, the presence or absence of the generation of the abnormality is determined based on the actual waveform data generated by the history acquiring portion 33 and the reference waveform data (see the waveform data shown in FIG. 17B) stored in the storage portion 32. More specifically, as shown by the waveform data in FIG. 17B, the time history waveform data of the suction pressure of the swash plate pump 2 pulsates in the diagnosis period at a cycle corresponding to the number $\alpha$ (in the present embodiment, $\alpha$=9) of pistons 14 included in the swash plate pump 2. To be specific, the time history waveform data of the suction pressure of the swash plate pump 2 pulsates at a cycle T/$\alpha$ obtained by dividing the cycle T by the number $\alpha$ of pistons 14. Therefore, the number of mountain parts formed in the reference waveform data is $\alpha$, and these mountain parts are substantially the same in shape as one another. On the other hand, when at least one of the pistons 14 in the swash plate pump 2 has the abnormality, disturbance is generated in the waveform data of the suction pressure in the actual waveform data. For example, although the mountain parts in the reference waveform data are formed independently, the mountain parts in the actual waveform data overlap each other as shown in FIG. 17A (for example, in FIG. 17A, the mountain part in a second section and the mountain part in a third section overlap each other), and therefore, the number of mountain parts in the actual waveform data is smaller than the number of mountain parts in the reference waveform data by one. The actual waveform data shown in FIG. 17A is just one example, and the actual waveform data forms various shapes depending on the looseness amount that is the amount of abnormality generated. As above, in the reference waveform data, the suction pressure pulsates at the cycle T/$\alpha$. However, when the abnormality is generated, the actual waveform data is disturbed without showing periodic pulsation unlike the reference waveform data. The failure detecting portion 34C compares the reference waveform data with the actual waveform data in order to detect whether or not the actual waveform data is disturbed so as to become different from the reference waveform data. For example, the following method is used as such comparing method.

To be specific, in order to compare the reference waveform data with the actual waveform data, the failure detecting portion 34C divides each of the actual waveform data and the reference waveform data into sections corresponding to the respective mountain parts (i.e., each of the reference waveform data and the actual waveform data is divided into sections corresponding to the number $\alpha$ of pistons 14). Then, the failure detecting portion 34C compares a $\beta$-th mountain part ($\beta$=1 to $\alpha$) of the reference waveform data with a $\beta$-th mountain part (3=1 to $\alpha$) of the actual waveform data regarding all the combinations and determines whether or not the $\beta$-th mountain parts in at least one of the combinations are different from each other. Whether or not the $\beta$-th mountain parts are different from each other is determined by, for example, the following method.

To be specific, a difference between the $\beta$-th mountain part of the reference waveform data and the $\beta$-th mountain part of the actual waveform data is integrated. Next, whether or not the obtained integrated value exceeds a predetermined threshold is determined. To be specific, when the integrated value does not exceed the threshold regarding all the mountain parts of the actual waveform data, the failure detecting portion 34C determines that there is no point of difference between the reference waveform data and the actual waveform data, and there is no abnormality. On the other hand, when the integrated value exceeds the threshold regarding at least one of the mountain parts of the actual waveform data, the failure detecting portion 34C determines that there is the point of difference between the reference waveform data and the actual waveform data, and there is the abnormality. The presence or absence of the abnormality is determined as above. When it is determined that there is no abnormality, the process returns to Step S11. On the other hand, when it is determined that there is the abnormality, the process proceeds to Step S16.

Step S16 that is the informing step informs of the presence of the abnormality at the piston 14. To be specific, the failure detecting portion 34C outputs an informing signal to the informing device 4. The informing device 4 informs of the presence of the abnormality of the piston 14 by making a monitor display it. After the informing device 4 informs, the process returns to Step S11, and the suction pressure is detected and stored.

The failure diagnosing device 3C of the pump unit 1C configured as above can detect the abnormality based on the suction pressure of the swash plate pump 2. A change in the suction pressure of the swash plate pump 2 due to an external factor is smaller than a change in discharge pressure of the swash plate pump 2 due to an external factor, and influence on the suction pressure of the swash plate pump 2 by the abnormality tends to appear significantly. Therefore, by detecting the abnormality based on the suction pressure of the swash plate pump 2, the abnormality can be accurately detected, and the detection accuracy of the failure can be improved. The failure diagnosing device 3C prestores the reference waveform data and can detect the generation of the abnormality by comparing the reference waveform data with the actual waveform data. Therefore, the generation of the abnormality can be detected accurately and easily.

Embodiment 5

Figure 18A:
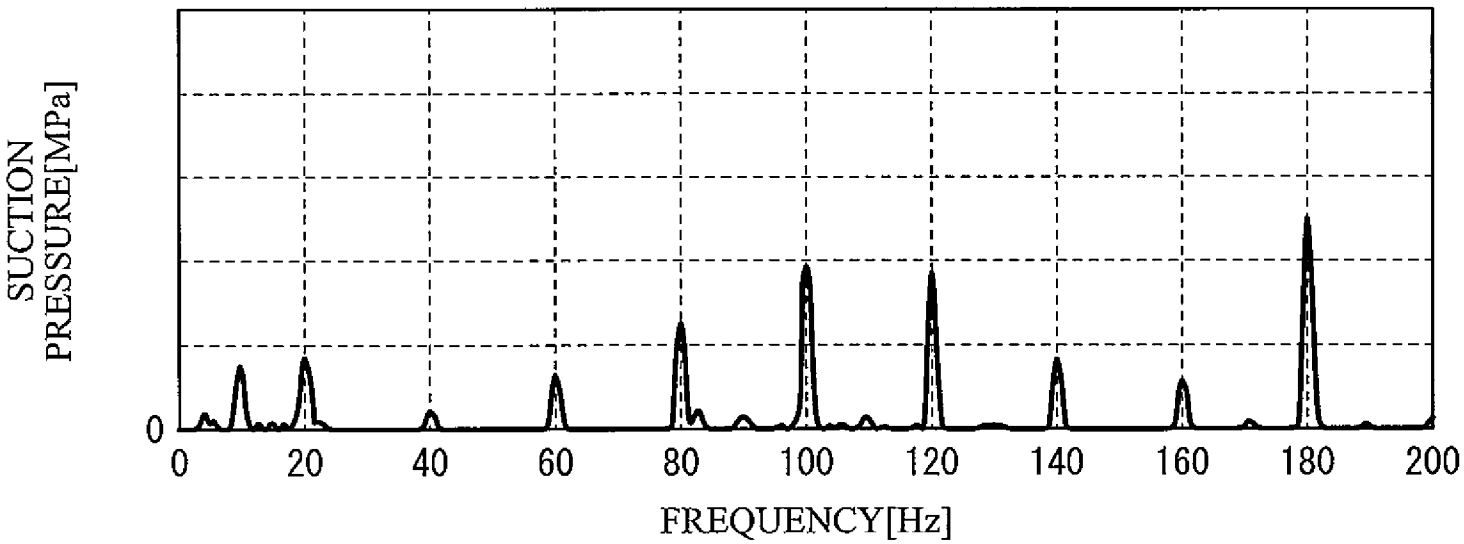
FIGS. 18A and 18B are graphs each showing a frequency spectrum of the suction pressure of the swash plate pump shown in FIG. 1.
Figure 18B:
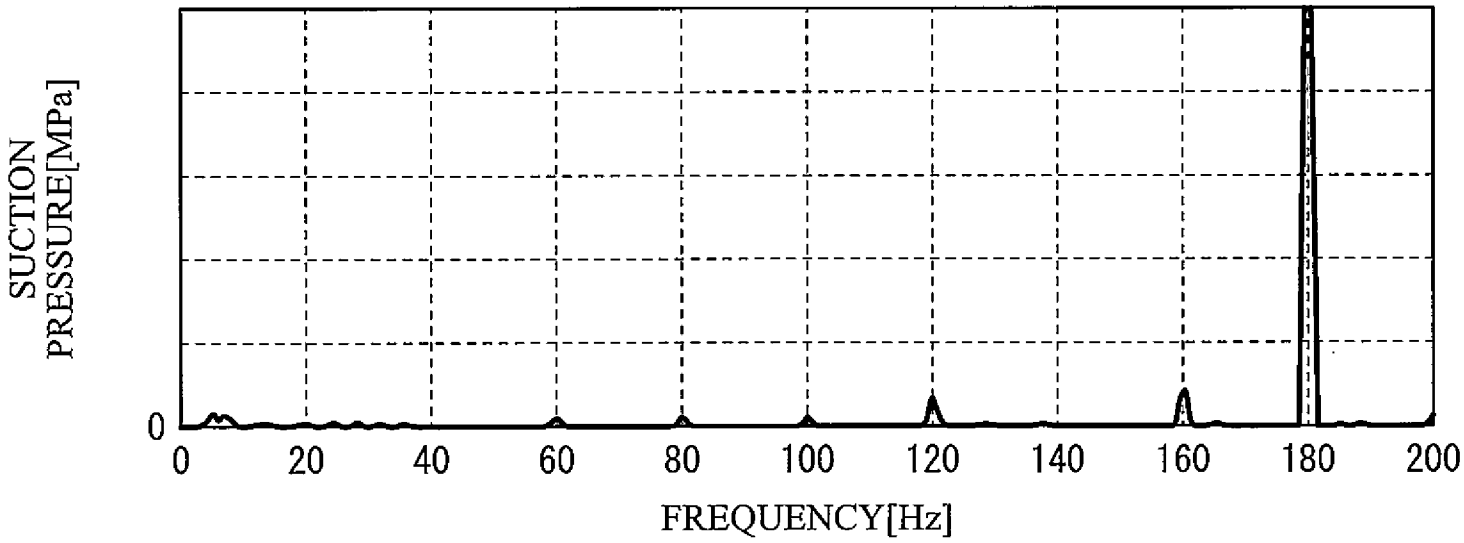

As shown in FIG. 1, the pump unit 1D of Embodiment 5 includes the swash plate pump 2, a failure diagnosing device 3D, the informing device 4, and the sensor device 5C. As with the failure diagnosing device 3 of Embodiment 1, the failure diagnosing device 3D includes a CPU, a ROM, a RAM, and the like. The failure diagnosing device 3D includes the pressure calculating portion 31C, the storage portion 32, the history acquiring portion 33, and a failure detecting portion 34D. The failure detecting portion 34D performs frequency analysis of the actual waveform data by FFT (fast Fourier transform) or the like, the actual waveform data being contained in the actual history data acquired by the history acquiring portion 33. When there is no abnormality regarding all the pistons 14 of the swash plate pump 2, as described above, the mountain parts that are the same in shape as one another appear in the time history waveform data of the suction pressure at the cycle $T/\alpha$. To be specific, in a frequency spectrum in this case, a component of a frequency $\alpha/T$ is mainly detected (see FIG. 18B). On the other hand, when there is the abnormality regarding one piston 14 of the swash plate pump 2, the mountain part having a different shape from the other mountain parts appears at every cycle T as shown in FIG. 18A. Therefore, in the frequency spectrum of the actual waveform data, a component of the frequency 1/T and components of multiples of the frequency 1/T are detected in addition to the component of the frequency $\alpha/T$. On this account, the failure detecting portion 34D can detect the abnormality of the piston 14 based on the frequency spectrum of the actual waveform data by performing the frequency analysis of the actual waveform data to calculate the frequency spectrum. To be specific, the failure detecting portion 34D can detect the presence or absence of the abnormality based only on the actual waveform data.

According to the failure diagnosing device 3D configured as above, when the failure diagnosing process is executed, as described above, the failure detecting portion 34D performs the frequency analysis of the actual waveform data to calculate the frequency spectrum in Step S15 that is the failure detecting step. Further, the failure detecting portion 34D detects whether or not a component other than the component of the frequency $\alpha/T$ is present in the frequency spectrum. It should be noted that whether or not the component other than the component of the frequency $\alpha/T$ is present is determined based on whether or not the suction pressure of each component exceeds a predetermined threshold. To be specific, when there is a component which is other than the component of the frequency $\alpha/T$ and exceeds the threshold, the failure detecting portion 34D determines that there is the abnormality. On the other hand, when there is no component which is other than the component of the frequency $\alpha/T$ and exceeds the threshold, the failure detecting portion 34D determines that there is no abnormality. The presence or absence of the abnormality is determined as above. When the failure detecting portion 34D determines that there is no abnormality, the process returns to Step S11. On the other hand, when the failure detecting portion 34D determines that there is the abnormality, the process proceeds to Step S16, and the presence of the abnormality is informed of in Step S16.

According to the pump unit 1D configured as above, the presence or absence of the abnormality can be accurately detected without the reference history data, and the failure diagnosing device 3D can be easily configured. It should be noted that the looseness amount may be detected based on the frequency spectrum although the failure diagnosing device 3D of the present embodiment does not detect the looseness amount. To be specific, in the swash plate pump 2, the mountain part of the frequency component corresponding to the looseness amount is contained in the actual waveform data, and the looseness amount can be detected based on the frequency component contained in the frequency spectrum and the magnitude of the frequency component.

Other than the above, the pump unit 1D of Embodiment 5 has the same operational advantages as the pump unit 1C of Embodiment 4.

Other Embodiments

The failure diagnosing device 3 of Embodiment 1 detects the generation of the abnormality by creating the reference waveform data and the actual waveform data and comparing the reference waveform data with the actual waveform data. However, creating the reference waveform data and the actual waveform data and comparing the reference waveform data with the actual waveform data do not necessarily have to be performed. For example, the generation of the abnormality may be detected by comparing the actual time history contained in the actual history data with the reference time history contained in the reference history data. The failure diagnosing device 3A of Embodiment 2 detects the generation of the abnormality by comparing a plurality of mountain parts in the actual waveform data with one another. However, the generation of the abnormality may be detected by comparing the suction flow rates of the actual time history with one another without creating the actual waveform data.

In the failure diagnosing devices 3 and 3A of Embodiments 1 and 2, the point of difference between the mountain parts is determined based on the integrated value of the difference between the mountain parts. However, Embodiments 1 and 2 are not limited to this method. For example, the point of difference may be determined by superposing the reference waveform data and the actual waveform data on each other or by using artificial intelligence (AI). Further, contents in the history are not limited to the time history and the time history waveform data. For example, the history may contain a rotation angle history in which the suction flow rate is stored in association with a rotation angle of the rotating shaft 12, and rotation angle history waveform data. Information associated with the suction flow rate is not limited to the time. In the failure diagnosing devices 3 and 3A of Embodiments 1 and 2, both the determination of the presence or absence of the abnormality and the calculation of the looseness amount are performed when detecting the generation of the abnormality. However, both of these do not necessarily have to be performed. To be specific, the generation of the abnormality may be detected only by the determination of the presence or absence of the abnormality. Further, the generation of the abnormality may be detected only by the calculation of the looseness amount without performing the determination of the presence or absence of the abnormality. The same is true for the failure diagnosing device 3B of Embodiment 3.

In each of the pump units 1, 1A, and 1B of Embodiments 1 to 3, the flow rate calculating portion (31, 31A) of the failure diagnosing device (3, 3A, 3B) is configured separately from the sensor device (5, 5A). However, each of the pump units 1, 1A, and 1B of Embodiments 1 to 3 does not necessarily have to have such configuration. To be specific, the flow rate calculating portion (31, 31A) may be configured integrally with the sensor device (5, 5A). The flow rate calculating portion 31 calculates the suction flow rate based on the signals from the two pressure sensors of the sensor device 5. However, the number of pressure sensors of the sensor device 5 may be one, and the flow rate calculating portion 31 may calculate the suction flow rate based on the signal from the pressure sensor.

Figure 12B:
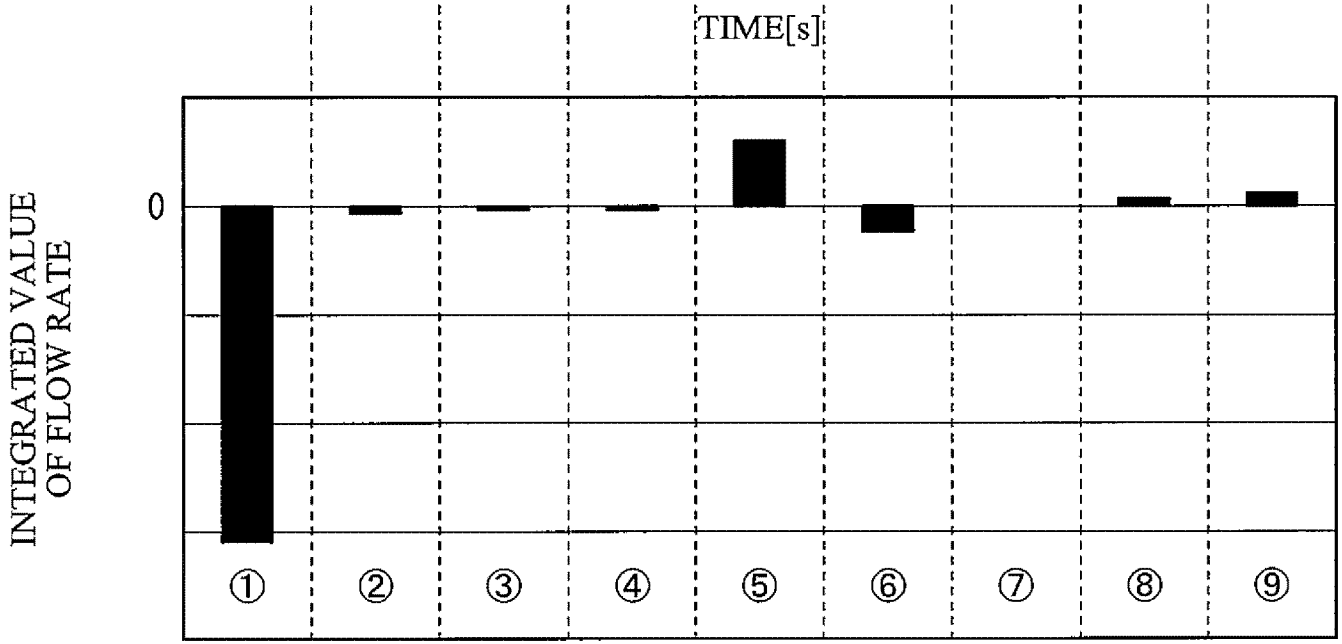
FIG. 12B is a graph showing a time-lapse change of an integrated value of a difference between the suction flow rates.

In the swash plate pump 2, the suction flow rate increases in the vicinity of the bottom dead center by the influence of the abnormality (see FIG. 10 and the fifth mountain part in each of FIGS. 12A and 12B). To be specific, the fifth mountain part in the reference waveform data and the fifth mountain part in the actual waveform data slightly differ from each other. Therefore, the presence or absence of the abnormality of the piston 14 and the looseness amount may be calculated by the integrated value obtained by integrating the difference between the fifth mountain parts. Further, as described above, it is preferable that the diagnosis period be set to the cycle T. However, the diagnosis period is not necessarily limited to such period. For example, in the pump unit 1 of Embodiment 1, the diagnosis period may be set to the cycle $T/\alpha$, and the failure diagnosis may be performed for each piston. Further, the diagnosis period may be set to a period $\gamma \times T$ ($\gamma$=1, 2, . . . ), and each piston 14 may be diagnosed plural times.

Further, in the pump units 1, 1A, and 1B of Embodiments 1 to 3, the number of pistons 14 and the number of mountain parts in the time history waveform data correspond to each other. Therefore, each of the actual waveform data and the reference waveform data is divided into the sections corresponding to the number $\alpha$ of pistons 14, and the presence or absence of the abnormality is detected by comparing the mountain parts with each other. However, Embodiments 1 to 3 are not limited to this. To be specific, if detecting only the presence or absence of the abnormality, the point of difference can be found only by simply comparing the actual waveform data with the reference waveform data without dividing the actual waveform data and the reference waveform data. Further, if detecting an approximate looseness amount, each of the actual waveform data and the reference waveform data may be divided into two or three sections.

In the pump units 1, 1A, and 1B of Embodiments 1 to 3, the variable displacement swash plate pump 2 is adopted. However, Embodiments 1 to 3 are not necessarily limited to the variable displacement swash plate pump, and a fixed displacement swash plate pump may be adopted. In the pump units 1, 1A, and 1B of Embodiments 1 to 3, the piston 14 is a male piston. However, the shape of the piston 14 is not necessarily limited to such shape. To be specific, the piston 14 may be a female piston including a partially-spherical accommodating space at one axial end side thereof. In this case, instead of the accommodating portion 15*a*, the shoe 15 includes a convex spherical portion that can be fitted to the accommodating space. The spherical joint portion 21 is formed by accommodating the convex spherical portion in the accommodating space of the piston 14 such that the convex spherical portion is slidable. Even when the female piston is adopted, the failure can be diagnosed as with when the piston 14 that is the male piston is adopted.

In the pump units 1, 1A, and 1B of Embodiments 1 to 3, when it is determined that there is the abnormality, the informing device 4 just informs. However, Embodiments 1 to 3 are not limited to such function. To be specific, when it is determined that there is the abnormality, the failure diagnosing device 3 outputs to a control device (not shown) a signal indicating that there is the abnormality. Based on this signal, the control device may limit the function of the swash plate pump 2 by lowering the rotational frequency of the prime mover or restricting the tilting operation of the swash plate 16.

Further, in the pump unit 1B of Embodiment 3, the presence or absence of the abnormality is detected based on the frequency spectrum of the suction flow rate. However, the presence or absence of the abnormality does not necessarily have to be detected by this method. For example, the frequency spectrum of the suction pressure may be calculated by using a pipe transmission property with respect to the frequency spectrum of the calculated suction flow rate, and the presence or absence of the abnormality may be detected based on the frequency spectrum of the suction pressure.

In the failure diagnosing device 3C of Embodiment 4, the reference waveform data and the actual waveform data are created, and the generation of the abnormality is detected by comparing the reference waveform data with the actual waveform data. However, the reference waveform data and the actual waveform data do not necessarily have to be compared with each other. For example, the generation of the abnormality may be detected by comparing the actual time history contained in the actual history data with the reference time history contained in the reference history data. As described above, when there is the abnormality, the actual waveform data is apparently disturbed with respect to the reference waveform data. Therefore, without comparison, the failure detecting portion 34 may determine the presence or absence of the abnormality based on the shape of the actual waveform data. Further, in the failure diagnosing device 3C of Embodiment 4, the point of difference between the mountain parts is determined based on the integrated value of the difference between the mountain parts. However, Embodiment 4 is not limited to this method. For example, the point of difference may be determined by superposing the reference waveform data and the actual waveform data on each other or by using artificial intelligence (AI). Further, contents in the history are not limited to the time history and the time history waveform data. For example, the history may contain a rotation angle history in which the suction flow rate is stored in association with a rotation angle of the rotating shaft 12, and rotation angle history waveform data. Information associated with the suction pressure is not limited to the time.

Further, in the pump units 1C and 1D of Embodiments 4 and 5, the pressure calculating portion 31C of the failure diagnosing device (3C, 3D) and the sensor device 5C are configured separately from each other. However, each of the pump units 1C and 1D of Embodiments 4 and 5 does not necessarily have to have such configuration. To be specific, the sensor device 5C may be configured integrally with the pressure calculating portion 31C. Further, as described above, it is preferable that the diagnosis period be set to the cycle T. However, the diagnosis period is not necessarily limited to such period. For example, in the pump unit 1C of Embodiment 4, the diagnosis period may be set to the cycle $T/\alpha$, and the failure diagnosis may be performed for each piston. Further, the diagnosis period may be set to a period $\gamma \times T$ ($\gamma$=1, 2, . . . ), and each piston 14 may be diagnosed plural times.

Further, in the pump units 1C and 1D of Embodiments 4 and 5, the number of pistons 14 and the number of mountain parts in the time history waveform data correspond to each other. Therefore, each of the actual waveform data and the reference waveform data is divided into the sections corresponding to the number $\alpha$ of pistons 14, and the presence or absence of the abnormality is detected by comparing the mountain parts with each other. However, Embodiments 4 and 5 are not limited to this. To be specific, if detecting only the presence or absence of the abnormality, the point of difference can be found only by simply comparing the actual waveform data with the reference waveform data without dividing the actual waveform data and the reference waveform data.

In the pump units 1C and 1D of Embodiments 4 and 5, the variable displacement swash plate pump 2 is adopted. However, Embodiments 4 and 5 are not necessarily limited to the variable displacement swash plate pump, and a fixed displacement swash plate pump may be adopted. In the pump units 1C and 1D of Embodiments 4 and 5, the piston 14 is a male piston. However, the shape of the piston 14 is not necessarily limited to such shape. To be specific, the piston 14 may be a female piston including a partially-spherical accommodating space at one axial end side thereof. In this case, instead of the accommodating portion 15*a*, the shoe 15 includes a convex spherical portion that can be fitted to the accommodating space. The spherical joint portion 21 is formed by accommodating the convex spherical portion in the accommodating space of the piston 14 such that the convex spherical portion is slidable. Even when the female piston is adopted, the failure can be diagnosed as with when the piston 14 that is the male piston is adopted.

In the pump units 1C and 1D of Embodiments 4 and 5, when it is determined that there is the abnormality, the informing device 4 just informs. However, Embodiments 4 and 5 are not limited to such function. To be specific, when it is determined that there is the abnormality, the failure diagnosing device (3C, 3D) outputs to a control device (not shown) a signal indicating that there is the abnormality. Based on this signal, the control device may limit the function of the swash plate pump 2 by lowering the rotational frequency of the prime mover or restricting the tilting operation of the swash plate 16.

Further, in the pump unit 1D of Embodiment 5, the presence or absence of the abnormality is detected based on the frequency spectrum of the suction pressure. However, the presence or absence of the abnormality does not necessarily have to be detected by this method. For example, the frequency spectrum of the suction flow rate may be calculated by using a pipe transmission property with respect to the frequency spectrum of the calculated suction pressure, and the presence or absence of the abnormality may be detected based on the frequency spectrum of the suction flow rate.

REFERENCE SIGNS LIST

1, 1A to 1D pump unit
2 swash plate pump
3, 3A to 3D failure diagnosing device
12 rotating shaft
13 cylinder block
14 piston
15 shoe
16 swash plate
21 spherical joint portion
31, 31A flow rate calculating portion
31C pressure calculating portion
32 storage portion
33 history acquiring portion
34, 34A to 34D failure detecting portion
5, 5A, 5C sensor device

The invention claimed is:

1. A failure diagnosing device for a swash plate pump, the swash plate pump including: a cylinder block configured to rotate about a predetermined axis; a plurality of pistons inserted in the cylinder block so as to be reciprocable; shoes provided at the respective pistons so as to be swingable; and a swash plate on which the shoes slidably rotate, wherein: when the cylinder block rotates, the plurality of pistons reciprocate in the cylinder block, and thereby, the swash plate pump sucks and discharges an operating liquid, the failure diagnosing device comprising:

a history acquiring portion configured to acquire actual history data indicating a time-lapse change of a suction flow rate or suction pressure in a predetermined period of time; and a failure detecting portion configured to detect generation of an abnormality between the piston and the shoe based on the actual history data acquired by the history acquiring portion.

2. The failure diagnosing device according to claim 1, wherein the actual history data indicates the time-lapse change of the suction flow rate in the predetermined period of time, the failure diagnosing device further comprising a storage portion configured to prestore reference history data indicating the time-lapse change of the suction flow rate in the predetermined period of time, the reference history data being used as a determination criterion when detecting the generation of the abnormality, wherein the failure detecting portion detects the generation of the abnormality by comparing the actual history data with the reference history data.

3. The failure diagnosing device according to claim 2, wherein:

the failure detecting portion divides each of the actual history data and the reference history data into a predetermined number of sections; and the failure detecting portion calculates a looseness amount based on a difference between the actual history data and the reference history data regarding each of the corresponding sections, the looseness amount indicating an amount of the abnormality.

4. The failure diagnosing device according to claim 1, wherein:

the actual history data indicates the time-lapse change of the suction flow rate in the predetermined period of time;

the history acquiring portion acquires the actual history data of the suction flow rate of the operating liquid sucked in a period in which the cylinder block rotates once; and the failure detecting portion divides the actual history data into a predetermined number of sections and detects the generation of the abnormality by comparing the suction flow rates in the respective sections with one another.

5. The failure diagnosing device according to claim 4, wherein the failure detecting portion calculates a looseness amount based on a difference between the suction flow rates in predetermined two of the sections, the looseness amount indicating an amount of the abnormality.

6. The failure diagnosing device according to claim 1, wherein:

the actual history data indicates the time-lapse change of the suction flow rate in the predetermined period of time;

the history acquiring portion acquires the actual history data containing actual waveform data indicating the time-lapse change of the suction flow rate in the predetermined period of time; and the failure detecting portion detects the generation of the abnormality based on the waveform data.

7. The failure diagnosing device according to claim 2, wherein:

the history acquiring portion acquires the actual history data containing actual waveform data indicating the time-lapse change of the suction flow rate in the predetermined period of time;

the storage portion stores the reference history data containing reference waveform data indicating the time-lapse change of the suction flow rate in the predetermined period of time; and the failure detecting portion detects the generation of the abnormality by comparing the actual waveform data with the reference waveform data.

8. The failure diagnosing device according to claim 1, wherein the actual history data indicates the time-lapse change of the suction pressure in the predetermined period of time, the failure diagnosing device further comprising a storage portion configured to prestore reference history data indicating the time-lapse change of the suction pressure in the predetermined period of time, the reference history data being used as a determination criterion when detecting the generation of the abnormality, wherein the failure detecting portion detects the generation of the abnormality by comparing the actual history data with the reference history data.

9. The failure diagnosing device according to claim 8, wherein:

the failure detecting portion divides each of the actual history data and the reference history data into a predetermined number of sections; and the failure detecting portion detects the generation of the abnormality based on a difference between the actual history data and the reference history data regarding each of the corresponding sections.

10. The failure diagnosing device according to claim 1, wherein:

the actual history data indicates the time-lapse change of the suction pressure in the predetermined period of time;

the history acquiring portion acquires the actual history data containing waveform data indicating the time-lapse change of the suction pressure in the predetermined period of time; and the failure detecting portion detects the generation of the abnormality based on the waveform data.

11. The failure diagnosing device according to claim 8, wherein:

the history acquiring portion acquires the actual history data containing actual waveform data indicating the time-lapse change of the suction pressure in the predetermined period of time;

the storage portion stores the reference history data containing reference waveform data indicating the time-lapse change of the suction pressure in the predetermined period of time; and the failure detecting portion detects the generation of the abnormality by comparing the actual waveform data with the reference waveform data.

12. The failure diagnosing device according to claim 1, wherein:

the failure detecting portion performs frequency analysis of the actual history data; and the failure detecting portion detects the generation of the abnormality based on a result of the frequency analysis.

13. A pump unit comprising:

the failure diagnosing device according to claim 1;

the swash plate pump; and a sensor device configured to output a signal corresponding to the suction flow rate or suction pressure of the operating liquid sucked by the swash plate pump, wherein the failure diagnosing device includes a flow rate calculating portion configured to calculate the suction flow rate in accordance with the signal from the sensor device or a pressure calculating portion configured to calculate the suction pressure in accordance with the signal from the sensor device.

14. A failure diagnosing method for a swash plate pump, the swash plate pump including: a cylinder block configured to rotate about a predetermined axis; a plurality of pistons inserted in the cylinder block so as to be reciprocable; shoes provided at the respective pistons so as to be swingable; and a swash plate on which the shoes slidably rotate, wherein: when the cylinder block rotates, the plurality of pistons reciprocate in the cylinder block, and thereby, the swash plate pump sucks and discharges an operating liquid, the failure diagnosing method comprising:

a detecting step of detecting a suction flow rate or suction pressure of the operating liquid sucked by the swash plate pump;

a history acquiring step of acquiring actual history data based on the suction flow rate or suction pressure detected in the detecting step, the actual history data indicating a time-lapse change of the suction flow rate or suction pressure in a predetermined period of time; and a failure detecting step of detecting generation of an abnormality between the piston and the shoe based on the actual history data acquired in the history acquiring step.

* * * * *